US011808507B2

(12) United States Patent
Becker et al.

(10) Patent No.: US 11,808,507 B2
(45) **Date of Patent: *Nov. 7, 2023**

(54) METHOD AND APPARATUS FOR INCREASING RATE OF ICE PRODUCTION IN AN AUTOMATIC ICE MAKER

(71) Applicant: WHIRLPOOL CORPORATION, Benton Harbor, MI (US)

(72) Inventors: Robert B. Becker, Stevensville, MI (US); Marcus R. Fischer, Stevensville, MI (US); Christopher R. McElvain, Amana, IA (US); Ryan D. Schuchart, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/881,958

(22) Filed: Aug. 5, 2022

(65) Prior Publication Data

US 2022/0373242 A1 Nov. 24, 2022

Related U.S. Application Data

(62) Division of application No. 16/872,690, filed on May 12, 2020, now Pat. No. 11,441,829, which is a (Continued)

(51) Int. Cl.
*F25C 1/04* (2018.01)
*F25C 1/243* (2018.01)
(Continued)

(52) U.S. Cl.
CPC ..... *F25C 1/04* (2013.01); *F25C 1/243* (2013.01); *F25C 5/06* (2013.01); *F25C 5/182* (2013.01);
(Continued)

(58) Field of Classification Search
CPC .... F25C 1/04; F25C 1/243; F25C 5/06; F25C 5/182; F25C 5/185; F25C 2305/022; F25C 2305/0221; F25C 2400/10; F25C 2500/02
See application file for complete search history.

(56) References Cited

U.S. PATENT DOCUMENTS 275,192 A 4/1883 Goodell
286,604 A 10/1883 Goodell
(Continued)

FOREIGN PATENT DOCUMENTS

AU 2006201786 A1 11/2007
CN 1989379 A 6/2007
(Continued)

OTHER PUBLICATIONS

Merriam-Webster definition of oscillate, http://www.Merriam-Webster.com/dictionary/oscillate, pp. 1-4, accessed from internet Aug. 6, 2015.
(Continued)

*Primary Examiner* — Ana M Vazquez
(74) *Attorney, Agent, or Firm* — Price Heneveld LLP

(57) ABSTRACT

A refrigerator includes a cabinet defining an interior volume and a door for accessing the interior volume. An ice maker is disposed within the interior volume harvesting ice. The ice maker includes a frame and a motor. An ice tray includes a first end engaged with the motor, a second end engaged to the frame and a plurality ice wells defined by a plurality of weirs including first and second sets of weirs positioned proximate the first and second ends respectively, and interior weirs positioned therebetween. Each of the first and second sets of weirs and the internal weirs include a passage bifurcating each weir into first and second weir portions. Each of the passages defined by the first and second sets of weirs have a cross-sectional area that is greater than a
(Continued)

cross-sectional area of any one of the passages defined by the internal weirs.

20 Claims, 24 Drawing Sheets

Related U.S. Application Data division of application No. 15/880,866, filed on Jan. 26, 2018, now Pat. No. 10,690,388, which is a division of application No. 14/921,236, filed on Oct. 23, 2015, now Pat. No. 9,915,458.

(60) Provisional application No. 62/067,725, filed on Oct. 23, 2014.

(51) Int. Cl.
*F25C 5/06* (2006.01)
*F25C 5/185* (2018.01)
*F25C 5/182* (2018.01)

(52) U.S. Cl.
CPC ..... *F25C 5/185* (2013.01); *F25C 2305/022* (2013.01); *F25C 2305/0221* (2021.08); *F25C 2400/10* (2013.01); *F25C 2500/02* (2013.01)

(56) References Cited

U.S. PATENT DOCUMENTS 301,539 A 7/1884 Vezin
1,407,614 A 2/1922 Wicks
1,616,492 A 2/1927 Lado
1,889,481 A 11/1932 Kennedy, Jr.
1,932,731 A 10/1933 Hathorne
2,027,754 A 1/1936 Smith
2,244,081 A 3/1938 Reeves
2,617,269 A 6/1949 Smith-Johannsen
2,481,525 A 9/1949 Mott
2,757,519 A 2/1954 Sampson
2,846,854 A 2/1954 Galin
2,683,356 A 7/1954 Green, Jr.
2,878,659 A 7/1955 Prance et al.
2,942,432 A 6/1960 Muffly
2,969,654 A 1/1961 Harle
3,144,755 A 7/1961 Kattis
2,996,895 A 8/1961 Lippincott
3,009,336 A 11/1961 Bayston et al.
3,016,719 A 1/1962 Reindl
3,033,008 A 5/1962 Davis
3,046,753 A 7/1962 Carapico, Jr.
3,053,059 A 9/1962 Voigtman
3,071,933 A 1/1963 Shoemaker
3,075,360 A 1/1963 Elfving et al.
3,075,364 A 1/1963 Kniffin
3,084,678 A 4/1963 Lindsay
3,084,878 A 4/1963 Helming et al.
3,093,980 A 6/1963 Frei
3,159,985 A 12/1964 Keighley
3,172,269 A 3/1965 Cole
3,192,726 A 7/1965 Newton
3,200,600 A 8/1965 Elfving
3,214,128 A 10/1965 Beck et al.
3,217,508 A 11/1965 Beck et al.
3,217,510 A 11/1965 Kniffin et al.
3,217,511 A 11/1965 Keighley
3,222,902 A 12/1965 Brejcha et al.
3,228,222 A 1/1966 Maier
3,255,603 A 6/1966 Johnson et al.
3,306,064 A 2/1967 Poolos
3,308,631 A 3/1967 Kniffin
3,318,105 A 5/1967 Burroughs et al.
3,321,932 A 5/1967 Orphey, Jr.
3,383,876 A 5/1968 Frohbieter
3,412,572 A 11/1968 Kesling
3,426,564 A 2/1969 Jansen et al.
3,451,237 A 6/1969 Baringer et al.
3,540,227 A 11/1970 Eyman, Jr. et al.
3,596,477 A 8/1971 Harley
3,638,451 A 2/1972 Brandt
3,646,792 A 3/1972 Hertel et al.
3,648,964 A 3/1972 Fox
3,677,030 A 7/1972 Nicholas
3,684,235 A 8/1972 Schupbach
3,775,992 A 12/1973 Bright
3,788,089 A 1/1974 Graves
3,806,077 A 4/1974 Pietrzak et al.
3,864,933 A 2/1975 Bright
3,892,105 A 7/1975 Bernard
3,908,395 A 9/1975 Hobbs
3,952,539 A 4/1976 Hanson et al.
4,006,605 A 2/1977 Dickson et al.
D244,275 S 5/1977 Gurbin
4,024,744 A 5/1977 Trakhtenberg et al.
4,059,970 A 11/1977 Loeb
4,062,201 A 12/1977 Schumacher et al.
4,078,450 A 3/1978 Vallejos
D249,269 S 9/1978 Pitts
4,142,377 A 3/1979 Fogt
4,142,378 A 3/1979 Bright et al.
4,148,457 A 4/1979 Gurbin
4,184,339 A 1/1980 Wessa
4,222,547 A 9/1980 Lalonde
4,261,182 A 4/1981 Elliott
4,288,497 A 9/1981 Tanaka et al.
4,402,185 A 9/1983 Perchak
4,402,194 A 9/1983 Kuwako et al.
4,412,429 A 11/1983 Kohl
4,424,683 A 1/1984 Manson
4,462,345 A 7/1984 Routery
4,483,153 A 11/1984 Wallace
4,487,024 A 12/1984 Fletcher et al.
4,550,575 A 11/1985 DeGaynor
4,562,991 A 1/1986 Wu
4,587,810 A 5/1986 Fletcher
4,627,946 A 12/1986 Crabtree
4,628,699 A 12/1986 Mawby et al.
4,669,271 A 6/1987 Noel
4,680,943 A 7/1987 Mawby et al.
4,685,304 A 8/1987 Essig
4,688,386 A 8/1987 Lane et al.
4,727,720 A 3/1988 Wernicki
4,843,827 A 7/1989 Peppers
4,852,359 A 8/1989 Manzotti
4,856,463 A 8/1989 Johnston
4,910,974 A 3/1990 Hara
4,942,742 A 7/1990 Burruel
4,970,877 A 11/1990 Dimijian
4,971,737 A 11/1990 Infanti
5,025,756 A 6/1991 Nyc
D318,281 S 7/1991 McKinlay
5,044,600 A 9/1991 Shannon
5,129,237 A 7/1992 Day et al.
5,157,929 A 10/1992 Hotaling
5,177,980 A 1/1993 Kawamoto et al.
5,196,127 A 3/1993 Solell
5,253,487 A 10/1993 Oike
5,257,601 A 11/1993 Coffin
5,272,888 A 12/1993 Fisher et al.
5,372,492 A 12/1994 Yamauchi
5,378,521 A 1/1995 Ogawa et al.
5,400,605 A 3/1995 Jeong
5,408,844 A 4/1995 Stokes
5,425,243 A 6/1995 Sanuki et al.
5,483,929 A 1/1996 Kuhn et al.
5,586,439 A 12/1996 Schlosser et al.
5,617,728 A 4/1997 Kim et al.
5,632,936 A 5/1997 Su et al.
5,618,463 A 8/1997 Rindler et al.
5,675,975 A 10/1997 Lee
5,761,920 A 6/1998 Wilson et al.
5,768,900 A 6/1998 Lee
5,826,320 A 10/1998 Rathke et al.
5,884,487 A 3/1999 Davis et al.

(56) References Cited

U.S. PATENT DOCUMENTS 5,884,490 A 3/1999 Whidden
D415,505 S 10/1999 Myers
5,970,725 A 10/1999 Lee
5,970,735 A 10/1999 Hobelsberger
6,058,720 A 5/2000 Ryu
6,062,036 A 5/2000 Hobelsberger
6,082,130 A 7/2000 Pastryk et al.
6,101,817 A 8/2000 Watt
6,145,320 A 11/2000 Kim
6,148,620 A 11/2000 Kumagai et al.
6,148,621 A 11/2000 Byczynski et al.
6,161,390 A 12/2000 Kim
6,179,045 B1 1/2001 Lilleaas
6,209,849 B1 4/2001 Dickmeyer
6,282,909 B1 9/2001 Newman et al.
6,289,683 B1 9/2001 Daukas et al.
6,357,720 B1 3/2002 Shapiro et al.
6,425,259 B2 7/2002 Nelson et al.
6,427,463 B1 8/2002 James
6,438,988 B1 8/2002 Paskey
6,467,146 B1 10/2002 Herman
6,481,235 B2 11/2002 Kwon
6,488,463 B1 12/2002 Harris
6,647,739 B1 11/2003 Kim et al.
6,688,130 B1 2/2004 Kim
6,688,131 B1 2/2004 Kim et al.
6,735,959 B1 5/2004 Najewicz
6,742,351 B2 6/2004 Kim et al.
6,763,787 B2 7/2004 Hallenstvedt et al.
6,782,706 B2 8/2004 Holmes et al.
D496,374 S 9/2004 Zimmerman
6,817,200 B2 11/2004 Willamor et al.
6,820,433 B2 11/2004 Hwang
6,823,689 B2 11/2004 Kim et al.
6,857,277 B2 2/2005 Somura
6,935,124 B2 8/2005 Takahashi et al.
6,951,113 B1 10/2005 Adamski
D513,019 S 12/2005 Lion et al.
7,010,934 B2 3/2006 Choi et al.
7,010,937 B2 3/2006 Wilkinson et al.
7,013,654 B2 3/2006 Tremblay et al.
7,051,541 B2 5/2006 Chung et al.
7,059,140 B2 6/2006 Zevlakis
7,062,925 B2 6/2006 Tsuchikawa et al.
7,062,936 B2 6/2006 Rand et al.
7,082,782 B2 8/2006 Schlosser et al.
7,131,280 B2 11/2006 Voglewede et al.
7,185,508 B2 3/2007 Voglewede et al.
7,188,479 B2 3/2007 Anselmino et al.
7,201,014 B2 4/2007 Hornung
7,204,092 B2 4/2007 Castrellón et al.
7,210,298 B2 5/2007 Lin
7,216,490 B2 5/2007 Joshi
7,216,491 B2 5/2007 Cole et al.
7,234,423 B2 6/2007 Lindsay
7,266,973 B2 9/2007 Anderson et al.
7,297,516 B2 11/2007 Chapman et al.
7,318,323 B2 1/2008 Tatsui et al.
7,386,993 B2 6/2008 Castrellón et al.
7,415,833 B2 8/2008 Leaver et al.
7,448,863 B2 11/2008 Yang
7,464,565 B2 12/2008 Fu
7,469,553 B2 12/2008 Wu et al.
7,487,645 B2 2/2009 Sasaki et al.
7,568,359 B2 8/2009 Wetekamp et al.
7,587,905 B2 9/2009 Kopf
7,614,244 B2 11/2009 Venkatakrishnan et al.
7,669,435 B2 3/2010 Joshi
7,681,406 B2 3/2010 Cushman et al.
7,703,292 B2 4/2010 Cook et al.
7,707,847 B2 5/2010 Davis et al.
7,744,173 B2 6/2010 Maglinger et al.
7,752,859 B2 7/2010 Lee et al.
7,762,092 B2 7/2010 Tikhonov et al.
7,770,985 B2 8/2010 Davis et al.
7,802,457 B2 9/2010 Golovashchenko et al.
7,832,227 B2 11/2010 Wu et al.
7,866,167 B2 1/2011 Kopf
7,870,755 B2 1/2011 Hsu et al.
7,918,105 B2 4/2011 Kim
7,963,120 B2 6/2011 An et al.
8,015,849 B2 9/2011 Jones et al.
8,037,697 B2 10/2011 LeClear et al.
8,074,464 B2 12/2011 Venkatakrishnan et al.
8,099,989 B2 1/2012 Bradley et al.
8,104,304 B2 1/2012 Kang et al.
8,117,863 B2 2/2012 Van Meter et al.
8,171,744 B2 5/2012 Watson et al.
8,196,427 B2 6/2012 Bae et al.
8,281,613 B2 10/2012 An et al.
8,322,148 B2 12/2012 Kim et al.
8,336,327 B2 12/2012 Cole et al.
8,371,133 B2 2/2013 Kim et al.
8,371,136 B2 2/2013 Venkatakrishnan et al.
8,375,739 B2 2/2013 Kim et al.
8,375,919 B2 2/2013 Cook et al.
8,408,023 B2 4/2013 Shin et al.
8,413,619 B2 4/2013 Cleeves
8,424,334 B2 4/2013 Kang et al.
8,429,926 B2 4/2013 Shaha et al.
8,438,869 B2 5/2013 Kim et al.
8,474,279 B2 7/2013 Besore et al.
8,516,835 B2 8/2013 Holter
8,516,846 B2 8/2013 Lee et al.
8,555,658 B2 10/2013 Kim et al.
8,616,018 B2 12/2013 Jeong et al.
8,646,283 B2 2/2014 Kuratani et al.
8,677,774 B2 3/2014 Yamaguchi et al.
8,677,776 B2 3/2014 Kim et al.
8,707,726 B2 4/2014 Lim et al.
8,746,204 B2 6/2014 Hofbauer
8,756,952 B2 6/2014 Adamski et al.
8,769,981 B2 7/2014 Hong et al.
8,820,108 B2 9/2014 Oh et al.
8,893,523 B2 11/2014 Talegaonkar et al.
8,925,335 B2 1/2015 Gooden et al.
8,943,852 B2 2/2015 Lee et al.
9,010,145 B2 4/2015 Lim et al.
9,021,828 B2 5/2015 Vitan et al.
9,127,873 B2 9/2015 Tarr et al.
9,140,472 B2 9/2015 Shin et al.
9,175,896 B2 11/2015 Choi
9,217,595 B2 12/2015 Kim et al.
9,217,596 B2 12/2015 Hall
9,228,769 B2 1/2016 Kim et al.
9,476,631 B2 10/2016 Park et al.
9,829,235 B2 11/2017 Visin
9,879,896 B2 1/2018 Koo
2002/0014087 A1 2/2002 Kwon
2003/0111028 A1 6/2003 Hallenstvedt
2004/0099004 A1 5/2004 Somura
2004/0144100 A1 7/2004 Hwang
2004/0206250 A1 10/2004 Kondou et al.
2004/0237566 A1 12/2004 Hwang
2004/0261427 A1 12/2004 Tsuchikawa et al.
2005/0067406 A1 3/2005 Rajarajan et al.
2005/0126185 A1 6/2005 Joshi
2005/0126202 A1 6/2005 Shoukyuu et al.
2005/0151050 A1 7/2005 Godfrey
2005/0160741 A1 7/2005 Park
2005/0160757 A1 7/2005 Choi et al.
2006/0016209 A1 1/2006 Cole et al.
2006/0032262 A1 2/2006 Seo et al.
2006/0053805 A1 3/2006 Flinner et al.
2006/0086107 A1 4/2006 Voglewede et al.
2006/0086134 A1 4/2006 Voglewede et al.
2006/0150645 A1 7/2006 Leaver
2006/0168983 A1 8/2006 Tatsui et al.
2006/0207282 A1 9/2006 Visin et al.
2006/0225457 A1 10/2006 Hallin
2006/0233925 A1 10/2006 Kawamura
2006/0242971 A1 11/2006 Cole et al.
2006/0288726 A1 12/2006 Mori et al.
2007/0028866 A1 2/2007 Lindsay

(56) References Cited

U.S. PATENT DOCUMENTS

| | | | |
|---|---|---|---|
| 2007/0107447 | A1 | 5/2007 | Langlotz |
| 2007/0119202 | A1 | 5/2007 | Kadowaki et al. |
| 2007/0130983 | A1 | 6/2007 | Broadbent et al. |
| 2007/0137241 | A1 | 6/2007 | Lee et al. |
| 2007/0193278 | A1 | 8/2007 | Polacek et al. |
| 2007/0227162 | A1 | 10/2007 | Wang |
| 2007/0227164 | A1 | 10/2007 | Ito et al. |
| 2007/0262230 | A1 | 11/2007 | McDermott |
| 2008/0034780 | A1 | 2/2008 | Lim et al. |
| 2008/0104991 | A1 | 5/2008 | Hoehne et al. |
| 2008/0145631 | A1 | 6/2008 | Bhate et al. |
| 2008/0236187 | A1 | 10/2008 | Kim |
| 2008/0264082 | A1 | 10/2008 | Tikhonov et al. |
| 2008/0289355 | A1 | 11/2008 | Kang et al. |
| 2009/0026349 | A1 | 1/2009 | Shokyuu |
| 2009/0049858 | A1 | 2/2009 | Lee et al. |
| 2009/0120306 | A1 | 5/2009 | DeCarlo et al. |
| 2009/0165492 | A1 | 7/2009 | Wilson et al. |
| 2009/0173089 | A1 | 7/2009 | LeClear et al. |
| 2009/0178428 | A1 | 7/2009 | Cho et al. |
| 2009/0178430 | A1 | 7/2009 | Jendrusch et al. |
| 2009/0187280 | A1 | 7/2009 | Hsu et al. |
| 2009/0199569 | A1 | 8/2009 | Petrenko |
| 2009/0211266 | A1 | 8/2009 | Kim et al. |
| 2009/0211271 | A1 | 8/2009 | Kim et al. |
| 2009/0223230 | A1 | 9/2009 | Kim et al. |
| 2009/0235674 | A1 | 9/2009 | Kern et al. |
| 2009/0272259 | A1 | 11/2009 | Cook et al. |
| 2009/0308085 | A1 | 12/2009 | DeVos |
| 2010/0011827 | A1 | 1/2010 | Stoeger et al. |
| 2010/0018226 | A1 | 1/2010 | Kim et al. |
| 2010/0031675 | A1 | 2/2010 | Kim et al. |
| 2010/0043455 | A1 | 2/2010 | Kuehl et al. |
| 2010/0050663 | A1 | 3/2010 | Venkatakrishnan et al. |
| 2010/0050680 | A1 | 3/2010 | Venkatakrishnan et al. |
| 2010/0055223 | A1 | 3/2010 | Kondou et al. |
| 2010/0095692 | A1 | 4/2010 | Jendrusch et al. |
| 2010/0101254 | A1 | 4/2010 | Besore et al. |
| 2010/0126185 | A1 | 5/2010 | Cho et al. |
| 2010/0139295 | A1 | 6/2010 | Zuccolo et al. |
| 2010/0163707 | A1 | 7/2010 | Kim |
| 2010/0180608 | A1 | 7/2010 | Shaha et al. |
| 2010/0197849 | A1 | 8/2010 | Momose et al. |
| 2010/0218518 | A1 | 9/2010 | Ducharme et al. |
| 2010/0218540 | A1 | 9/2010 | McCollough et al. |
| 2010/0218542 | A1 | 9/2010 | McCollough et al. |
| 2010/0251730 | A1 | 10/2010 | Whillock, Sr. |
| 2010/0257888 | A1 | 10/2010 | Kang et al. |
| 2010/0293969 | A1 | 11/2010 | Braithwaite et al. |
| 2010/0313594 | A1 | 12/2010 | Lee et al. |
| 2010/0319367 | A1 | 12/2010 | Kim et al. |
| 2010/0326093 | A1 | 12/2010 | Watson et al. |
| 2011/0005263 | A1 | 1/2011 | Yamaguchi et al. |
| 2011/0023502 | A1 | 2/2011 | Ito et al. |
| 2011/0062308 | A1 | 3/2011 | Hammond et al. |
| 2011/0146312 | A1 | 6/2011 | Hong et al. |
| 2011/0192175 | A1 | 8/2011 | Kuratani et al. |
| 2011/0214447 | A1 | 9/2011 | Bortoletto et al. |
| 2011/0239686 | A1 | 10/2011 | Zhang et al. |
| 2011/0265498 | A1 | 11/2011 | Hall |
| 2012/0007264 | A1 | 1/2012 | Kondou et al. |
| 2012/0011868 | A1 | 1/2012 | Kim et al. |
| 2012/0023996 | A1 | 2/2012 | Herrera et al. |
| 2012/0047918 | A1 | 3/2012 | Herrera et al. |
| 2012/0073538 | A1 | 3/2012 | Hofbauer |
| 2012/0085302 | A1 | 4/2012 | Cleeves |
| 2012/0174613 | A1 | 7/2012 | Park et al. |
| 2012/0240613 | A1 | 9/2012 | Saito et al. |
| 2012/0291473 | A1 | 11/2012 | Krause et al. |
| 2014/0363712 | A1 | 12/2014 | Wohrle et al. |
| 2015/0330678 | A1 | 11/2015 | Hu |
| 2016/0370078 | A1 | 12/2016 | Koo |
| 2017/0051966 | A1 | 2/2017 | Powell |
| 2017/0074527 | A1 | 3/2017 | Visin |
| 2017/0191722 | A1 | 7/2017 | Bertolini et al. |
| 2017/0241694 | A1 | 8/2017 | Ji et al. |
| 2017/0292748 | A1 | 10/2017 | Gullett |
| 2017/0307281 | A1 | 10/2017 | Morgan et al. |
| 2017/0314841 | A1 | 11/2017 | Koo et al. |
| 2017/0343275 | A1 | 11/2017 | Kim |
| 2018/0017306 | A1 | 1/2018 | Miller |
| 2018/0017309 | A1 | 1/2018 | Miller et al. |

FOREIGN PATENT DOCUMENTS

| | | | |
|---|---|---|---|
| CN | 102353193 | A | 9/2011 |
| DE | 202006012499 | U1 | 10/2006 |
| DE | 102008042910 | A1 | 4/2010 |
| DE | 102009046030 | | 4/2011 |
| EP | 1653171 | | 5/2006 |
| EP | 1710520 | A2 | 11/2006 |
| EP | 1821051 | A1 | 8/2007 |
| EP | 2078907 | A2 | 7/2009 |
| EP | 2375200 | | 10/2011 |
| EP | 2444761 | A2 | 4/2012 |
| EP | 2660541 | | 11/2013 |
| EP | 2743606 | | 6/2014 |
| EP | 2743608 | A2 | 6/2014 |
| FR | 2078162 | | 11/1971 |
| FR | 2771159 | A1 | 5/1999 |
| GB | 657353 | A | 9/1951 |
| GB | 2139337 | A | 11/1984 |
| JP | S489460 | | 2/1973 |
| JP | 5044356 | | 5/1975 |
| JP | S5278848 | | 6/1977 |
| JP | S60141239 | A | 7/1985 |
| JP | S6171877 | U | 5/1986 |
| JP | 6435375 | | 3/1989 |
| JP | H01196478 | A | 8/1989 |
| JP | H01210778 | A | 8/1989 |
| JP | H01310277 | A | 12/1989 |
| JP | H024185 | A | 1/1990 |
| JP | H0231649 | A | 2/1990 |
| JP | H02143070 | A | 6/1990 |
| JP | H03158670 | A | 7/1991 |
| JP | H03158673 | A | 7/1991 |
| JP | H0415069 | A | 1/1992 |
| JP | H04161774 | A | 6/1992 |
| JP | H4260764 | A | 9/1992 |
| JP | H051870 | A | 1/1993 |
| JP | H05248746 | A | 9/1993 |
| JP | H05332562 | A | 12/1993 |
| JP | H063005 | A | 1/1994 |
| JP | H0611219 | A | 1/1994 |
| JP | H06323704 | A | 11/1994 |
| JP | H10227547 | A | 8/1998 |
| JP | H10253212 | A | 9/1998 |
| JP | H11223434 | A | 8/1999 |
| JP | 2000039240 | A | 2/2000 |
| JP | 2000346506 | A | 12/2000 |
| JP | 2001041620 | A | 2/2001 |
| JP | 2001041624 | A | 2/2001 |
| JP | 2001221545 | A | 8/2001 |
| JP | 2001355946 | | 12/2001 |
| JP | 2002139268 | A | 5/2002 |
| JP | 2002295934 | A | 10/2002 |
| JP | 2002350019 | A | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2003336947 | A | 11/2003 |
| JP | 2004053036 | A | 2/2004 |
| JP | 2004278894 | A | 10/2004 |
| JP | 2004278990 | A | 10/2004 |
| JP | 2005164145 | A | 6/2005 |
| JP | 2005180825 | A | 7/2005 |
| JP | 2005195315 | A | 7/2005 |
| JP | 2006022980 | A | 1/2006 |
| JP | 2006071247 | A | 3/2006 |
| JP | 2006323704 | A | 11/2006 |
| JP | 2007232336 | A | 9/2007 |

(56) References Cited

FOREIGN PATENT DOCUMENTS

| | | | |
|---|---|---|---|
| JP | 4333202 | B2 | 9/2009 |
| KR | 20010109256 | A | 12/2001 |
| KR | 20060013721 | A | 2/2006 |
| KR | 20060126156 | A | 12/2006 |
| KR | 100845860 | B1 | 7/2008 |
| KR | 20090132283 | A | 12/2009 |
| KR | 20100123089 | A | 11/2010 |
| KR | 20110037609 | A | 4/2011 |
| RU | 2365832 | | 8/2009 |
| SU | 1747821 | A1 | 7/1992 |
| TW | 424878 | U | 3/2001 |
| WO | 8808946 | A1 | 11/1988 |
| WO | 2008052736 | A1 | 5/2008 |
| WO | 2008056957 | A2 | 5/2008 |
| WO | 2008061179 | A2 | 5/2008 |
| WO | 2008143451 | A1 | 11/2008 |
| WO | 2012023717 | | 2/2012 |
| WO | 2012025369 | | 3/2012 |
| WO | 2013087357 | | 6/2013 |
| WO | 2017039334 | A2 | 3/2017 |

OTHER PUBLICATIONS

"Manufacturing Processes—Explosive Sheetmetal Forming," Engineer's Handbook, 2006, web archive, last accessed Jan. 19, 2016, at http://www.engineershandbook.com/MfgMethods/exforming.htm, pp. 1-3.

"Nickel Alloys for Electronics," A Nickel Development Institute Reference Book, 1988, 131 pages, Series N 11 002, NiDI Nickel Development Institute.

Daehn, "High-Velocity Metal Forming," ASM Handbook, 2006, pp. 405-418, vol. 148, ASM International.

Daehn, et al., "Hyperplacstic Forming: Process Potential and Factors Affecting Formability," MRS Proceedings, 1999, at p. 147, vol. 601.

Jimbert et al., "Flanging and Hemming of Auto Body Panels using the Electro Magnetic Forming technology," 3rd International Conference on High Speed Forming, 2008, pp. 163-172.

Shang et al., "Electromagnetically assisted sheet metal stamping," Journal of Materials Processing Technology, 2010, pp. 868-874, 211.

METHOD AND APPARATUS FOR INCREASING RATE OF ICE PRODUCTION IN AN AUTOMATIC ICE MAKER

CROSS-REFERENCE TO RELATED APPLICATIONS

This application is a continuation of U.S. patent application Ser. No. 16/872,690 filed May 12, 2020, entitled METHOD AND APPARATUS FOR INCREASING RATE OF ICE PRODUCTION IN AN AUTOMATIC ICE MAKER, now U.S. Pat. No. 11,441,829, which is a divisional of U.S. patent application Ser. No. 15/880,866 filed Jan. 26, 2018, entitled METHOD AND APPARATUS FOR INCREASING RATE OF ICE PRODUCTION IN AN AUTOMATIC ICE MAKER, now U.S. Pat. No. 10,690,388, which is a divisional of U.S. patent application Ser. No. 14/921,236 filed Oct. 23, 2015, entitled METHOD AND APPARATUS FOR INCREASING RATE OF ICE PRODUCTION IN AN AUTOMATIC ICE MAKER, now U.S. Pat. No. 9,915,458, which claims priority to and the benefit under 35 U.S.C. § 119(e) of U.S. Provisional Patent Application No. 62/067,725, filed on Oct. 23, 2014, entitled METHOD AND APPARATUS FOR INCREASING RATE OF ICE PRODUCTION IN AN AUTOMATIC ICE MAKER, the entire disclosures of which are hereby incorporated herein by reference.

BACKGROUND OF THE DISCLOSURE

It is desirable in modern appliances to reduce the energy used to the minimum necessary to accomplish any given task. In the typical automatic ice maker within a refrigerator, a heater is used to heat the ice tray after the water is frozen, to allow the ice to release from the ice tray. After the ice is frozen, the heater may melt a layer of ice back into water. The ice tray is then rotated and the layer of water between the ice and the ice tray allows the ice to slip out of the ice tray and into an ice bin. Typically this type of ice maker is called a "Fixed Mold" ice maker because a shaft running the length of the ice maker down the center axis rotates and fingers coming out of it flip the cubes out of the mold and into the bin.

Stand-alone ice trays may harvest the ice without the use of a heater by twisting the ice tray breaking the bonds of the ice cubes to the tray. Stand-alone ice trays that are manually filled with water may be set in a freezer to freeze into ice, and then removed for harvesting. The ice from a stand-alone tray may be harvested either individually or into an ice bucket. Twisting a stand-alone ice tray breaks the ice connections between ice cubes and ice wells while also deforming the ice tray, thereby forcing the ice cube out of the ice well by mechanical means.

SUMMARY OF THE DISCLOSURE

One aspect of the current disclosure includes a refrigerator with a cabinet and an exterior surface of the refrigerator. The refrigerator has a freezing compartment and a refrigerator compartment within the interior of the cabinet separated by a mullion. The refrigerator also has a plurality of doors, each door providing selective access to one of the refrigerator compartment and the freezing compartment, including a refrigerator door having an exterior surface and an inner cabinet interior facing surface and a freezer door having an exterior surface and an inner cabinet interior facing surface that define a freezer door interior space. The refrigerator also has an automatic ice maker disposed within either the refrigerator door interior space or the freezer door interior space and configured to harvest a plurality of ice cubes formed within the ice wells without the use of a heating element. The ice maker has a frame, a motor, and an ice tray. The ice tray has a first end operably and rotationally engaged with the motor, a second end engaged to the frame, and a plurality ice wells configured in at least three rows of at least seven ice wells. The ice wells are defined by weirs, including a set of weirs positioned proximate the first end and set of weirs position proximate the second end and interior weirs positioned therebetween. The first set of weirs and the second set of weirs each have a passage partially bifurcating the weir into a first weir portion and a second weir portion. The passages of the first set of weirs and the second set of weirs have a greater cross-sectional area than a passage positioned between ice wells adjacent an interior weir.

Another aspect of the current disclosure includes a refrigerator having a cabinet defining a cabinet interior volume and an exterior surface of the refrigerator and having a freezing compartment and a refrigerator compartment within the interior of the cabinet separated by a mullion. The refrigerator has more than one door, each door providing selective access to one of the refrigerator compartment and the freezing compartment, including a refrigerator door having an exterior surface and an inner cabinet interior facing surface that define a freezer door interior space and a freezer door having an exterior surface and an inner cabinet interior facing surface that define a freezer door interior space. The refrigerator has an automatic ice maker within either the refrigerator door interior space or the freezer door interior space. The automatic ice maker can harvest at least 3.5 pounds of ice per 24-hour period formed within the ice wells without the use of a heating element. The ice maker has a frame, a motor, and an ice tray. The ice tray has a first end engaged with the motor, a second end engaged to the frame and ice wells configured in at least three rows of at least seven.

Yet another aspect of the current disclosure includes a refrigerator having a cabinet defining a cabinet interior volume and an exterior surface of the refrigerator and having a freezing compartment and a refrigerator compartment within the interior of the cabinet separated by a mullion. The refrigerator has doors, each door providing selective access to one of the refrigerator compartment and the freezing compartment. The doors include a refrigerator door having an exterior surface and an inner cabinet interior facing surface that define a freezer door interior space and a freezer door having an exterior surface and an inner cabinet interior facing surface that define a freezer door interior space. The refrigerator has an automatic ice maker within either the refrigerator door interior space or the freezer door interior space and is configured to harvest at least 3.5 pounds of ice per 24 hour period formed within the ice wells without the use of a heating element. The ice maker has a frame, a motor, and an ice tray. The ice tray has a first end operably and rotationally engaged with the motor, a second end engaged to the frame, and ice wells configured in at least three rows of at least seven ice wells.

Another aspect of the current disclosure includes a refrigerator having a cabinet defining a cabinet interior volume and an exterior surface of the refrigerator and having a freezing compartment and a refrigerator compartment within the interior of the cabinet separated by a mullion. The refrigerator has a plurality of doors providing selective access to the refrigerator compartment and wherein each of the doors include an exterior surface and an inner cabinet interior facing surface that define a refrigerator door interior space. The refrigerator has an automatic ice maker within one of refrigerator door interior spaces to harvest a plurality of ice cubes formed within the ice wells without the use of a heating element. The ice maker has a frame having a first end and a second end, a motor on the first end of the frame, and an ice tray. The ice tray has a first end operably and rotationally engaged with the motor, a second end engaged to the frame, and a plurality of ice cavities configured in at least three rows of at least seven ice cavities.

Another aspect of the current disclosure includes a method of increasing the rate of production of ice in an automatic, heaterless, in-appliance, motor-driven ice maker of an appliance, including dispensing at least about 110 mL water from the appliance into an ice tray. The ice tray has a plurality of ice forming cavities and at least three rows of ice forming cavities. The method also includes freezing the water dispensing into the ice tray within about 90 minutes. The ice cavities are not larger than 25 mm by 25 mm by 18 mm, and releases the ice formed within the ice cavities by twisting the ice tray without the use of a heater. The above steps are repeated so at least about 3.5 pounds of ice are formed within a 24-hour period.

Another aspect of the current disclosure includes a refrigerator including a cabinet defining an interior volume and at least one door for providing selective access to the interior volume. An automatic ice maker is disposed within the interior volume and is configured to harvest a plurality of ice cubes. The ice maker includes a frame, a motor, an ice tray comprising a first end operably and rotationally engaged with the motor and a second end engaged to the frame. A plurality of ice wells are defined by a plurality of weirs including a first set of weirs positioned proximate the first end and a second set of weirs positioned proximate the second end and interior weirs positioned therebetween. Each of the first and second sets of weirs and the internal weirs comprise a passage at least partially bifurcating each weir into a first weir portion and a second weir portion, wherein each of the passages defined by the first and second sets of weirs have a cross-sectional area that is greater than a cross-sectional area of any one of the passages defined by the internal weirs.

Another aspect of the current disclosure includes a method of producing ice within a heaterless ice maker disposed within a door of a refrigerating appliance including dispensing at least about 110 mL water from the refrigerating appliance into an ice tray set within a frame, wherein the ice tray has a plurality of ice forming cavities divided into three rows of ice forming cavities, wherein each of the ice cavities of the plurality of ice forming cavities defines a volume of less than 11.25 mL. The method also includes freezing the water dispensed into the ice tray for about 90 minutes, wherein the water in the plurality of ice cavities is substantially formed into ice pieces. The method also includes rotating first and second ends of the ice tray in a first direction relative to the frame, wherein the first and second ends are rotated the same rotational distance. The method also includes rotating the first end of the ice tray an additional rotational distance and in the first direction relative to the frame and maintaining the second end of the ice tray in a substantially fixed position relative to the frame, wherein the ice pieces are released from the ice cavities free of the use of a heater. The method also includes dropping the ice pieces from the ice cavities into the ice bin in a substantially vertical direction, wherein a textured ice-retaining portion of an inner facing surface of each ice forming cavity at least partially increases an angle of repose of the ice piece with respect to the inner facing surface.

Another aspect of the current disclosure includes an appliance door for a refrigerating appliance including an outer wrapper, an inner liner defining an ice making receptacle and an interior space defined between the outer wrapper and the inner liner. An ice maker is disposed proximate a top portion of the ice making receptacle. A sliding assembly is defined within an inward-facing surface of the ice making receptacle. An ice storage bin is operable between an engaged state, wherein the ice storage bin is fully inserted into the ice making receptacle, a disengaged state, wherein the ice storage bin is removed from the ice making receptacle, and a lateral sliding state, wherein the ice storage bin is operated laterally and free of rotation between the engaged and disengaged states. The ice storage bin and the ice making receptacle cooperatively define an ice delivery mechanism that selectively delivers ice pieces from an inner volume of the ice storage bin to an ice delivery zone proximate the outer wrapper.

These and other aspects, objects, and features of the present disclosure will be understood and appreciated by those skilled in the art upon studying the following specification, claims, and appended drawings.

DETAILED DESCRIPTION OF THE EMBODIMENTS

Figure 1:
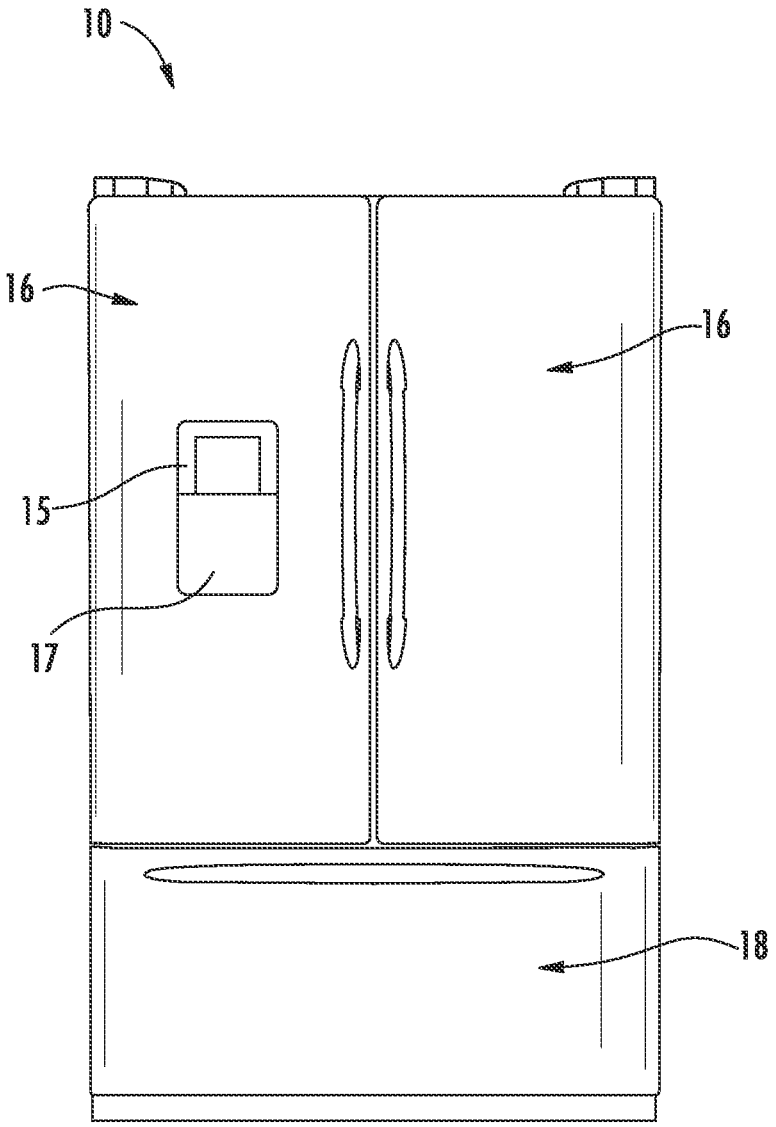
FIG. 1 is an elevated front view of a French-Door Bottom Mount type refrigerator.

For purposes of description herein, The terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, reference numeral 10 generally designates a refrigerator with an automatic ice maker 20. As described below, an automatic ice maker is an ice maker either as a stand-alone appliance, or within another appliance such as a refrigerator, wherein the ice making process is typically induced, carried out, stopped, and the ice is harvested with substantially no user input.

Figure 2A:
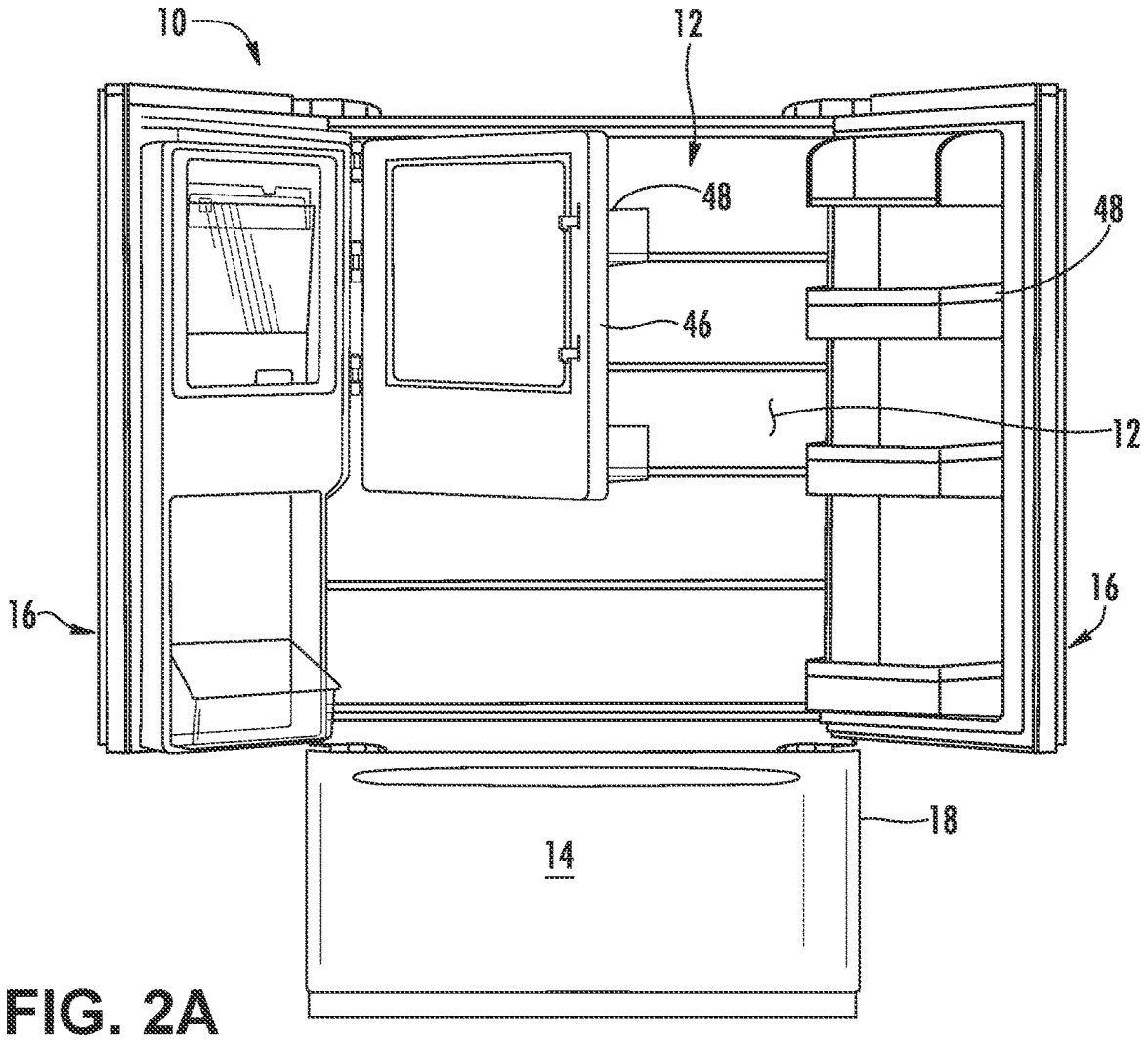
FIG. 2A is an elevated front view of a French-Door Bottom Mount type refrigerator with the refrigerator compartment doors open.
Figure 2B:
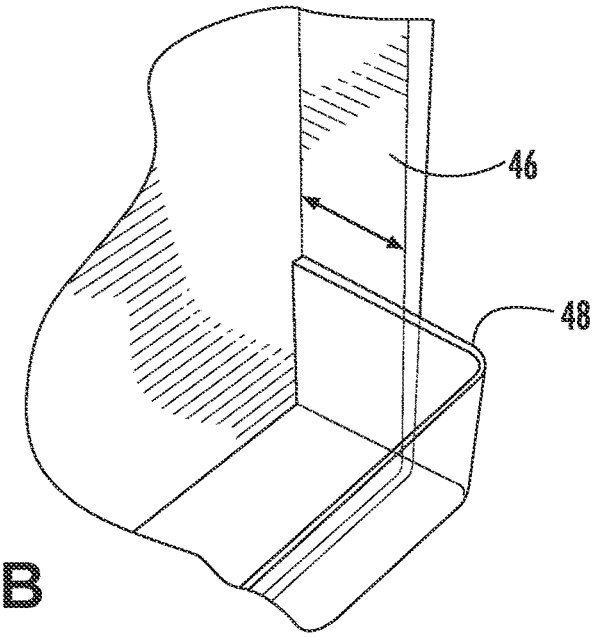
FIG. 2B is a perspective view of an aspect of an access door for the ice maker.

FIG. 1 generally shows a refrigerator 10 of the French-Door Bottom Mount type, but it is understood that this disclosure could apply to any type of refrigerator, such as a side-by-side, two-door bottom mount, or a top-mount type. As shown in FIGS. 1 and 2B, the refrigerator 10 may have a fresh food compartment 12 configured to refrigerate and not freeze consumables within the fresh food compartment 12, and a freezer compartment 14 configured to freeze consumables within the freezer compartment 14 during normal use. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16.

Figure 3:
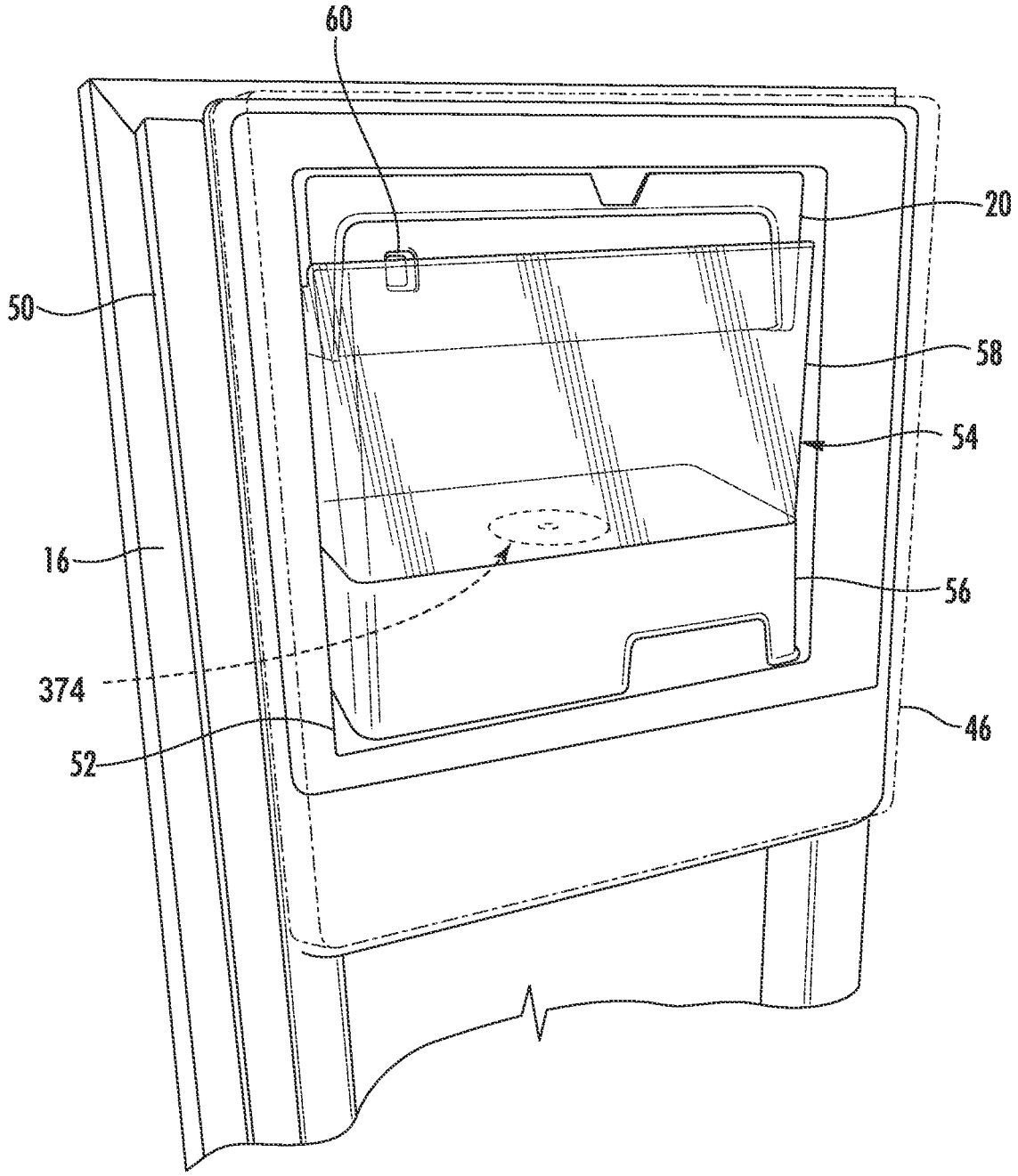
FIG. 3 is a perspective view of the interior of one door of the refrigerator compartment with the ice maker and ice bin installed.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F. As shown in FIGS. 2A-3, an ice maker 20 may be located on a door 16 to the refrigerated fresh food compartment 12. As described below, an ice maker 20 is defined as an assembly of a bracket, a motor 24, an ice tray 28, a bail arm 98 connected to the motor 24, at least one wire harness and at least one thermistor. The door 16 may include an ice maker 20 and ice bin access door 46 hingedly connected to one of the doors 16 for the refrigerator 10 along the side proximate the hinge for the door 16 of the refrigerator 10 carrying the ice maker 20, i.e. the vertical edge closest to the cabinet. The hinge may be a single or multiple hinge(s) and may be spaced along the entire edge, substantially the entire edge, or more frequently two hinges may be used with one close to the top edge of the access door 46 and one close to the bottom edge of the access door 46.

Significantly, due at least in part to the access door 46 and the design and size of the ice maker 20, the access door 46 has a peripheral edge liner that extends outward from the surface of the access door 46 and defines a dike wall. The dike walls extend from at least the two vertical sides, more typically all four sides and define a door bin receiving volume along the surface of the access door 46. The access door 46 is selectively operable between an open position, in which the ice maker 20 and the ice storage bin 54 are accessible, and a closed position, in which the ice maker 20 and the ice storage bin 54 are not accessible. The access door 46 may also include door bins 48 that are able to hold smaller food items. The door bins 48 may also be located on or removably mounted to the access door 46 and at least partially spaced within the door bin receiving volume of the access door 46. While not typically the case, the ice maker 20 may also be located exterior the fresh food compartment 12, such as on top of the refrigerator cabinet, in a mullion between the fresh food compartment 12 and the freezer compartment 14, in a mullion between two fresh food compartments 12, or anywhere else an automatic, motor driven ice maker 20 may be located.

The refrigerator 10 may also have a duct or duct system (not shown) with an inlet in the freezer compartment 14 and an outlet in the fresh food compartment 12. The duct may be situated such that the length of the duct necessary to direct air from the freezer compartment 14 to the fresh food compartment 12 is minimized, reducing the amount of heat gained in the travel between the inlet and the outlet. The duct outlet located in fresh food compartment 12 may be positioned at a location near the ice maker 20. The refrigerator 10 may also have one or more fans, but typically has a single fan (not shown) located in the freezer compartment 14 to force air from the freezer compartment 14 to the fresh food compartment 12. The colder air from the freezer compartment 14 is needed in the ice maker 20 because air below the freezing point of water is needed to freeze the water that enters the ice maker 20 to freeze into ice cubes. In the embodiment shown, the ice maker 20 is located in the fresh food compartment 12, which typically holds air above the freezing point of water.

In various embodiments, where the ice maker 20 is located in a compartment or location other than in the freezer compartment 12, a fan is needed to force the air to the ice maker 20. In other embodiments, the fan or fans may be located either in the freezer compartment 14, the fresh food compartment 12, or in another location where the fan is able force air through the duct. The ice maker 20 is often positioned within a door of the refrigerator 10 to allow for delivery of ice through the door 16 in a dispensing area 17 on the exterior of the refrigerator 10, typically at a location on the exterior below the level of the ice storage bin 54 to allow gravity to force the ice down an ice dispensing chute into the refrigerator door 16. The chute extends from the bin to the dispensing area 17 and ice is typically pushed into the chute using an electrical power driven auger. Ice is dispensed from the ice storage bin 54 to the user of the refrigerator 10.

The refrigerator 10 may also have a water inlet that is fastened to and in fluid communication with a household water supply of potable water. Typically the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller (not shown) that sends electrical signals to the one or more valves when prompted by a user that water is desired or if an ice making cycle is required.

FIGS. 2A-3 show enlarged view of the ice making assembly according to one aspect of the present disclosure and demonstrates one feature of the present disclosure, namely, the significantly smaller overall size of the ice making assemblies of the present disclosure over prior the prior heaterless ice making assemblies.

FIG. 3 shows a closer view of a door 16 with the access door 46 in hidden lines to show the ice maker 20. The door 16 may have an inner liner 50 which defines an ice maker receiving space 52 in which the ice maker 20 and an ice storage bin 54 of the ice maker assembly are disposed. The ice maker receiving space 52 is typically about 750-800 cubic inches and preferably about 763 cubic inches (12,512 cubic cm). The ice maker receiving space 52 is typically less than 11×12×7 inches and preferably about 10.5×11×6.5 inches or about 267 mm×279 mm×165 mm. The ice maker 20 may be located at an upper portion of the ice maker receiving space 52. The ice bin 54 may be located below the ice maker 20 such that as ice is harvested, the ice maker 20 uses gravity to transfer the ice from the ice maker 20 to the ice storage bin 54. The ice storage bin 54 may comprise an ice bin base 56 and one or more ice bin walls 58 that extends upwardly from the perimeter of the ice bin base 56. The ice maker 20 may include an on/off switch 60. The on/off switch 60 may be located on the ice maker 20 in a location that is accessible to a user without removing the ice maker 20 from the door 16 or the refrigerator 10. The ice bin wall 58 may be configured such that when the ice storage bin 54 is placed in the door 16, the on/off switch 60 is inaccessible to the user, and when the ice storage bin 54 is removed from the door 16, the on/off switch 60 is accessible to a user. The ice storage bin wall 58 may be made of a clear plastic material such as a copolyester so that a user can see the on/off switch 60 even while inaccessible when the ice bin 54 is in place. However, the front portion of the ice bin wall 58 typically extends to cover the on/off switch 60 when in the installed position to prevent inadvertent actuation of the on/off switch 60. The front portion of the ice bin wall 58 also typically extends upward to form a lip that extends around at least a portion of the ice maker 20 to further retain ice.

Figure 4A:
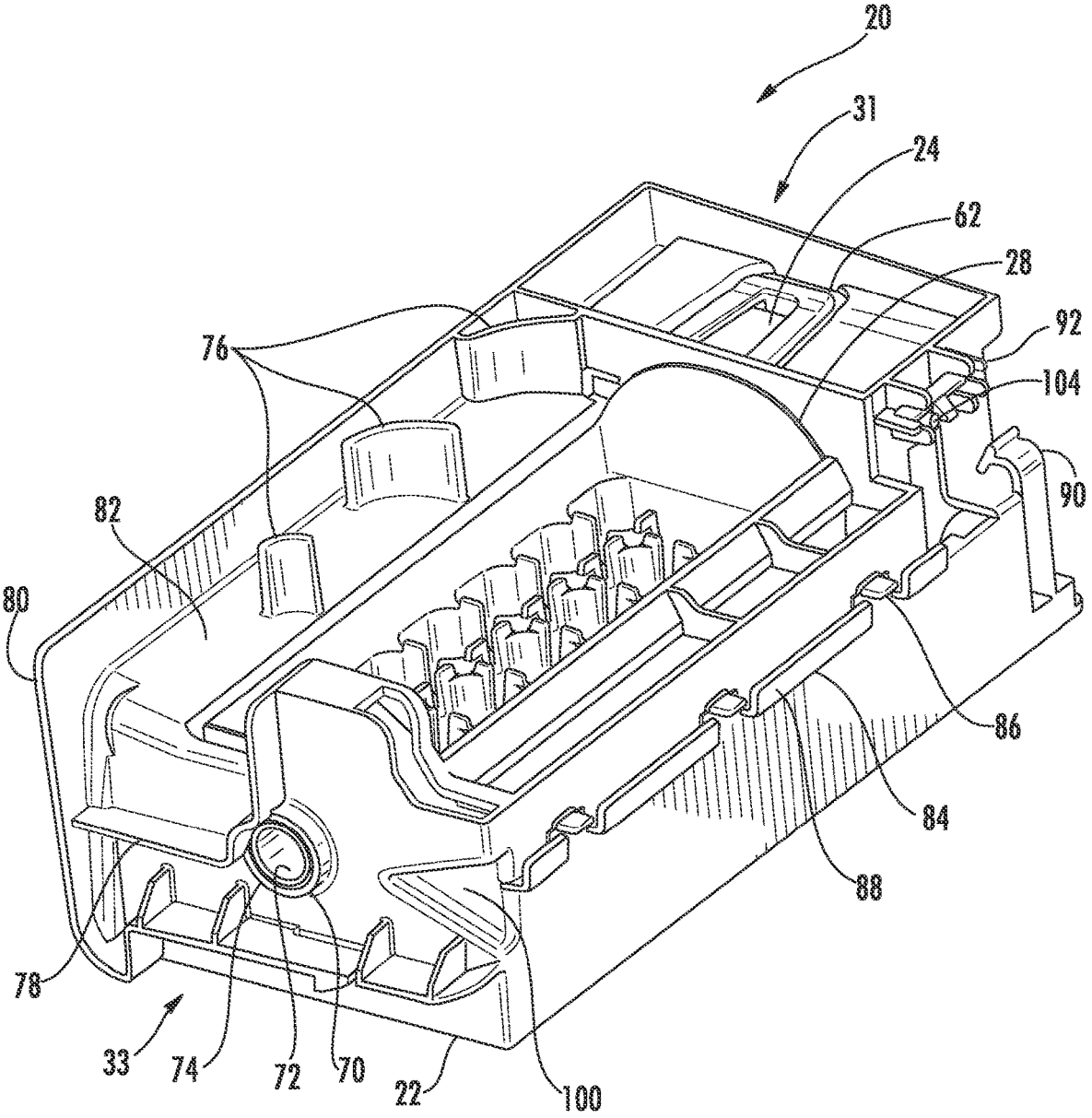
FIG. 4A is an isometric view of the top of an ice maker according to an aspect of the present disclosure.

FIGS. 4A (top perspective view) and 4B (top perspective view from the opposing side) show isometric views of the ice maker 20. The ice maker 20 may comprise a bracket 22, a motor 24, and an ice tray 28. The bracket 22 is used to locate the motor 24 and the ice tray 28. The motor 24 may be disposed on one end 31 of the bracket 22. The motor 24 may be held in place on the bracket 22 by motor locking tabs 62 and 94, which allow the motor 24 to be placed in the bracket 22, but will not release the motor 24 until the motor locking tabs 62 and 94 are actuated by a user, typically by hand and without the use of tools. In another embodiment, the motor 24 may be disposed on the door 16 of the fresh food compartment 12. As shown in FIG. 4A, the bracket 22 and ice tray 28 are configured to fit together in such a way that the combination is free of apertures between the motor 24 and the ice wells 38 (exemplified in FIGS. 5A and 5B) in order to keep water out of the area where the motor 24 is installed.

As shown in FIGS. 4A-8, the ice tray 28 has a first end 30 and a second end 32. The first end 30 is configured to engage the motor 24 through a motor interface 64. The motor interface 64 may include a rib structure 68, which produces added strength and structure to the interface, and an aperture 66. The motor interface 64 is located at the first end 30 of the ice tray 28. The aperture 66 as shown may be a dog-bone shape aperture, although other shapes are contemplated. This unique structural shape allows for superior transfer of torque from the motor 24 to the ice tray 28 and also avoids plastic deformation or any other undesirable effect or permanent damage from repeated twisting action of the ice tray 28 of the present disclosure. The ice tray 28 is typically made of a polypropylene-polyethylene copolymer that allows for easy release of the ice and good durability of the ice tray 28 in a freezing environment, but may also contain minor amounts of other materials and polymers that would not affect the release and durability characteristics of the ice tray 28.

The ice tray 28 typically has a second end 32 with a bracket interface 70. The bracket interface 70 may be generally circular in shape and correspond to a circular tray interface 74 on the bracket 22. The outside diameter of the bracket interface 70 on the ice tray 28 is typically slightly smaller than the inside diameter of the tray interface 74 on the bracket 22 and is configured to fit within the tray interface 74. This fit allows for rotational movement of the ice tray 28 with respect to the bracket 22 without allowing for excessive lateral movement of the bracket interface 70 within the tray interface 74.

The bracket 22 further includes a front flange 80 and an air inlet flange 78 defining an ice maker supply duct 82 that supplies air from the outlet in the fresh food compartment 12 to the ice tray 28. The bracket 22 further comprises a plurality of air deflectors or vanes 76 generally disposed within the ice maker cold air supply duct 82. The air deflectors 76 typically extend upward from the bracket 22 along the cold air supply duct 82 of the bracket 22 of the ice maker 20. From two to five air deflectors 76 are typically used and most typically three air deflectors 76 are used. The plurality of air deflectors 76 may direct the air in the ice maker supply duct 82 uniformly over the ice tray 28. In the embodiment shown, there are three air deflectors or vanes 76. Depending upon the particular design of the ice maker 20, fewer air deflectors 76 may not generally uniformly direct the air over the ice tray 28, and more deflectors 76 may require more power to push the air through the cold air supply duct 82 of the ice maker 20. The air deflectors 76 can vary in size. By way of example, and not limitation, the air deflectors 76 may be larger in size the further they are positioned from the cold air source. The air deflectors 76 typically increase in arcuate distance to catch and redirect more cold air as the air passes by each successive air deflector 76. In the exemplified aspect of the device, three air deflectors 76 are configured as shown in FIG. 4A. The air deflectors 76 are included to provide even cooling across the ice tray 28.

The air inlet flange 78 may be located at a location generally corresponding to the outlet of the duct in the fresh food compartment 12. The air inlet flange 78 and the front flange 80 constrain air exiting the duct outlet in the fresh food compartment 12 and prevent the air from reaching the fresh food compartment 12. The bracket 22 typically further includes a plurality of wire harness supports 84 and tabs 86 for containing or otherwise stowing electrical wiring for the ice maker 20 from view. These wire harness supports 84 and tabs 86 may be disposed on the back of the bracket 22 in an alternating pattern. This alternating pattern of supports 84 and tabs 86 allows an ice maker wire harness to be held in place in the back of the ice maker 20 and out of sight of a user. The wire harness, upon installation, may rest on the top of the supports 84. The supports 84 may further include an upstanding flange 88 to hold the wire harness in place and prevent the wire harness from removal off of the support 84. The wire harness may be disposed below the tabs 86. The tabs 86 are located between the supports 84 and at a height above the supports 84 not greater than the diameter of the wire harness, which forces the wire harness into a serpentine-like shape along the back side of the ice maker 20 and frictionally retains the ice maker 20, preventing the wire harness from undesirable side-to-side movement. The bracket 22 may further include a wire harness clip 90 which biases and frictionally holds the wire harness in place at the point of entry into the ice maker 20 when installed. While an alternating configuration of supports 84 and tabs 86 are exemplified, other non-alternating or semi-alternating patterns are contemplated.

The ice maker 20 may include a first thermistor 106 (exemplified in FIG. 6B) that can be disposed in the ice tray 28, as well as a second thermistor 104 that can be disposed at least proximate the ice maker receiving space 52. The first thermistor 106 may be disposed below and in thermal communication with the ice tray 28, and the second thermistor 104 may be disposed on the bracket 22 adjacent the motor 24. Each thermistor 104, 106 may be connected to the wire harness. The wire for the first thermistor 106 may extend from the wire harness at the end of the ice maker 20 distal the motor 24. The first thermistor wire may also be separate from the wire harness and be routed through an aperture 72 in the bracket interface 70 of the ice tray 28. The wire may be routed under the ice tray 28 and along its axis of movement as shown by line X-X in FIG. 8. The first thermistor 106 may be disposed on the bottom of the ice tray 28 and held in place by a thermistor bracket 108 (exemplified in FIG. 6B). The thermistor bracket 108 may include insulation that is configured to ensure the first thermistor 106 is reading substantially only the temperature of the ice tray 28, and not the fresh food compartment 12 or other areas outside of the ice maker receiving area 52.

The second thermistor 104 is typically located or proximate the flow of air from the freezer compartment 14, out of the refrigerator compartment outlet, and over the ice tray 28. The second thermistor 104 may be placed on the bracket 22 downstream of the ice tray 28. In one embodiment as shown in FIG. 4A, the second thermistor 104 or ice compartment thermistor is disposed adjacent the motor 24 on the bracket 22, and held in place by an ice compartment thermistor mounting bracket 92. The ice compartment thermistor mounting bracket 92 may comprise one or more clips and flanges configured such that the mounting bracket 92 allows the second thermistor 104 to install and remove without the use of tools. The mounting bracket 92 typically only frictionally retains the second thermistor 104. The thermistor mounting bracket 92 also may be configured to prevent the second thermistor 104 from moving laterally in any direction.

Figure 5A:
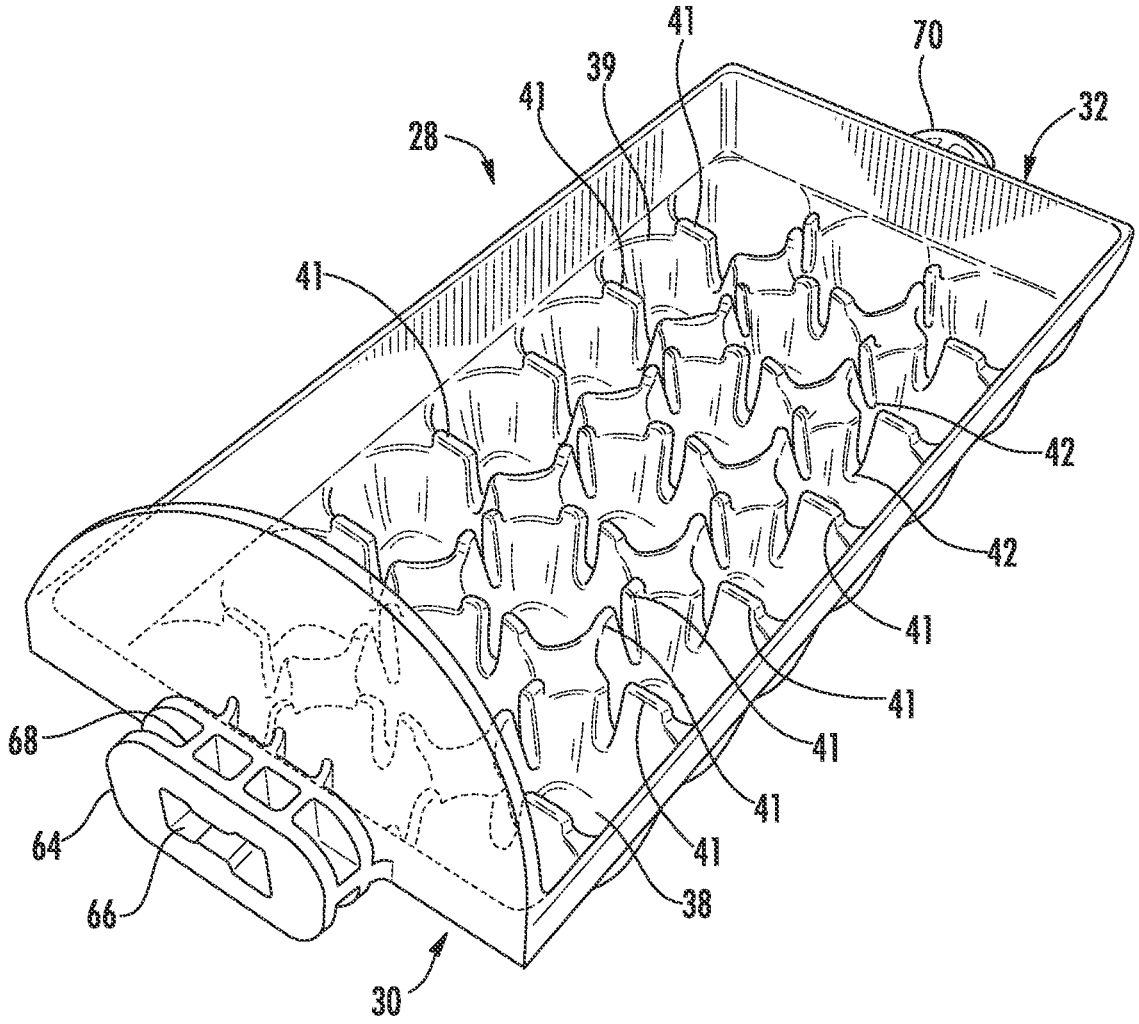
FIG. 5A is an isometric perspective view of an ice tray according to an aspect of the present disclosure.
Figure 5B:
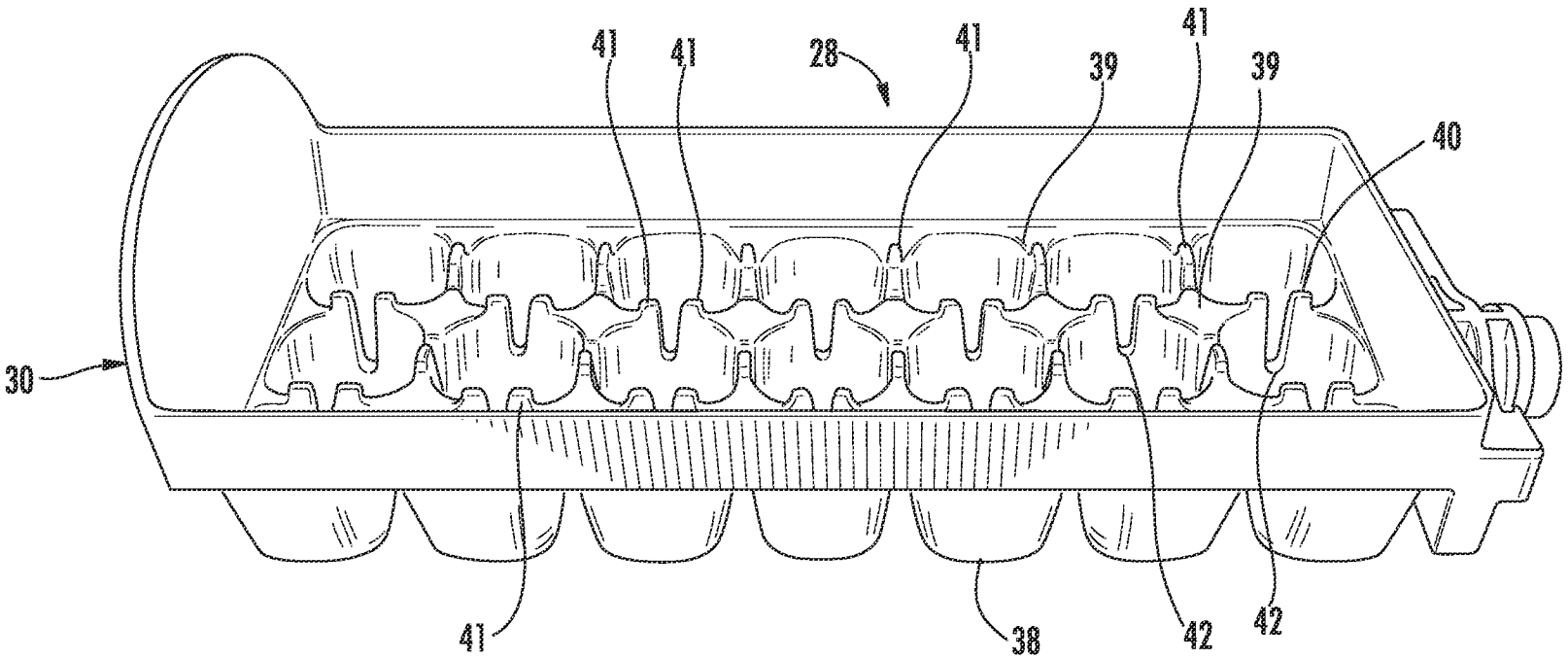
FIG. 5B is a perspective view of an ice tray according to an aspect of the present disclosure.

Turning to FIGS. 5A and 5B, the ice tray 28 may have a number of ice wells 38. The ice wells 38 may be lined up in rows configured parallel with an axis of twist X-X (exemplified in FIG. 8), and columns configured normal to the axis of twist X-X. The ice tray 28 may have weirs 40 between the ice wells 38. The weirs 40 may have water channels or passages 42 that allow water to flow through the weirs 40 between the ice wells 38 when the ice tray 28 is being filled. The ice tray 28 of the present disclosure typically further has an ice tray top surface 39. The weirs 40 typically have an upwardly extending projecting portion 41 that extends or projects above the top surface 39. This allows for generally even water flow through passage 42 during a fill cycle when the ice wells 38 or cavities are filled with water before freezing.

Figure 6A:
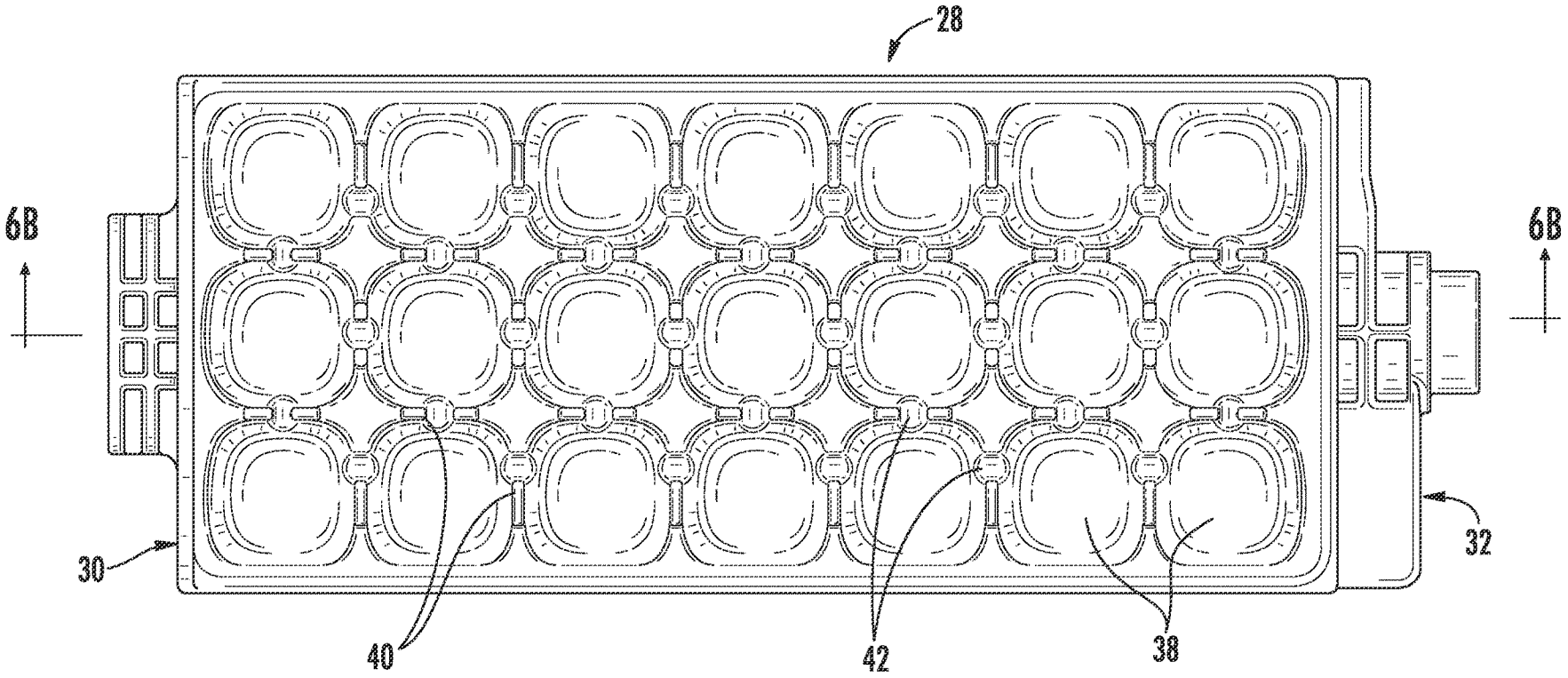
FIG. 6A is a top plan view of an ice tray according to an aspect of the present disclosure.
Figure 6B:
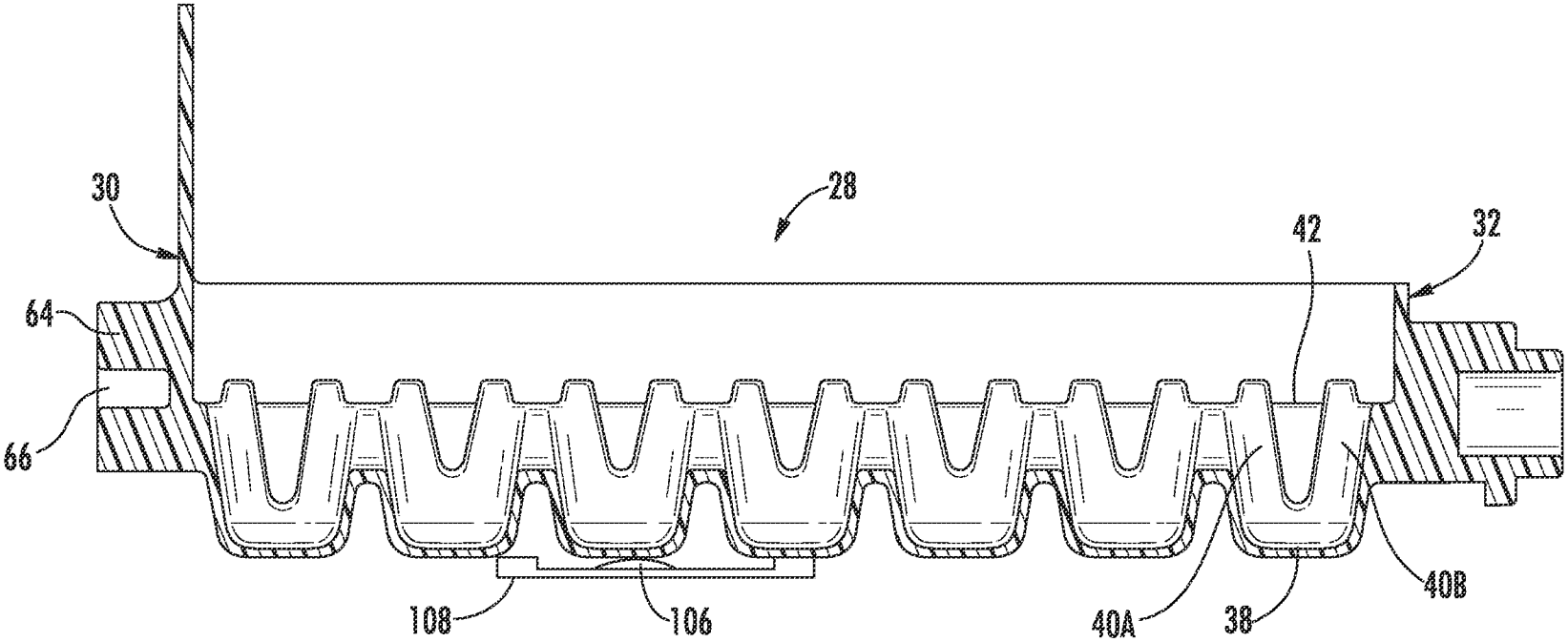
FIG. 6B is a cross-section through an ice tray taken along line 6B-6B in FIG. 6A according to an aspect of the present disclosure.
Figure 7:
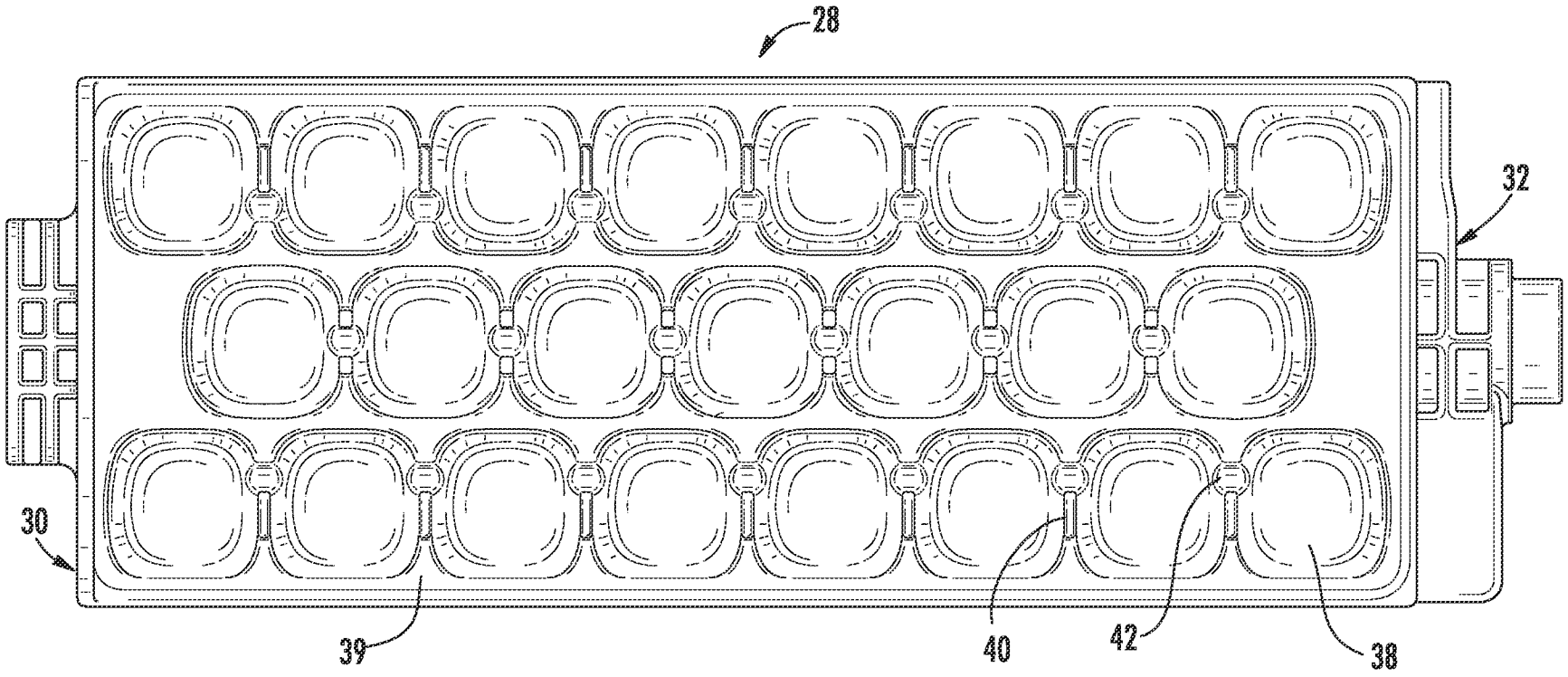
FIG. 7 is a top perspective view of an ice tray taken along line 9A-9A in FIG. 8 according to an aspect of the present disclosure.

FIGS. 6A and 6B show the weirs 40 and the water channels or passages 42 in more detail. FIG. 6B shows a section through one row of wells 38, as shown by the section in FIG. 6A. Each ice well 38 may be separated by a weir 40. The weirs 40 define the shape and size of the ice well 38. The weir 40 may have a passage 42 that allows fluid to flow more freely between the ice wells 38. The passage 42 separates the weir 40 into two parts, shown in FIG. 6B as 40A and 40B. Although the water channels or passages 42 may be substantially uniform along the row of ice wells 38, the area of the passage 42 may be larger in an ice well 38 in a position closer to the first end 30 and a second end 32 (as exemplified in FIG. 6B) than the area of a passage 42 in an ice well 38 that is closer to the middle of a row of ice wells 38 between the ends. In another embodiment, the ice wells 38 may be staggered as shown in FIG. 7.

To assemble the ice maker 20, an operator may attach the bail arm 98 with a fastener such as a screw. The operator may then place the ice tray 28 into the bracket 22 by the first end 30, and the rotate the second end 32 into the bracket tray interface 74. The motor 24 may then be snapped into place by hand and without the use of tools, engaging the first end 30 of the ice tray 28. A wire harness including a motor connector may then be connected to the motor 24. The wire harness is then routed through the wire harness supports 84, tabs 86 and flanges 88 to the end of the bracket 22 distal the motor 24. The first thermistor 106 may then be placed on the underside of the ice tray 28 and a thermistor bracket 108 snapped over the first thermistor 106 by hand without the use of tools, thereby holding the first thermistor 106 in place. The thermistor bracket 108 typically includes a thermally resistant layer in contact with the first thermistor 106. This thermally resistant layer is designed to keep the first thermistor 106 in contact with the ice tray 28 and out of the flow of air over the ice tray 28. Keeping the first thermistor 106 out of the flow of air prevents the thermistor 106 from reading a frozen temperature before the ice is ready for harvesting. A compartment thermistor, such as the second thermistor 104, may then be snapped into place by hand and without the use of tools into the thermistor mounting bracket 92 on the bracket 22.

Figure 4B:
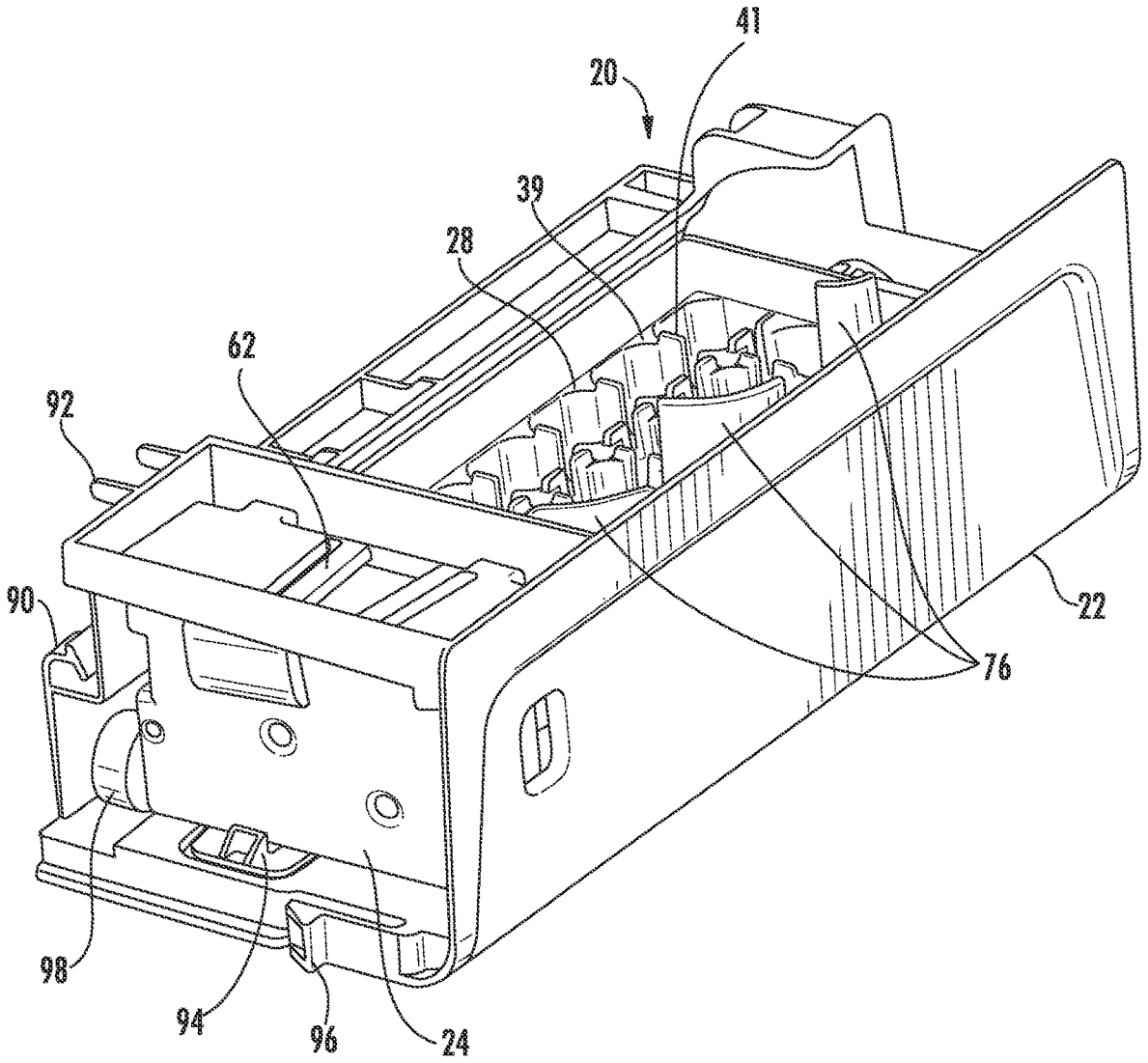
FIG. 4B is another isometric view of the top of an ice maker.

The ice maker 20 may then be snapped into place on the door 16 of the refrigerator 10 by hand and without the use of tools, and the wire harness may then be connected to a refrigerator wire harness. The ice maker 20 may be held in place by an ice maker snap 96 as shown in FIG. 4B. To remove the ice maker 20, a user may simply actuate the ice maker snap 96 to free the ice maker 20 from the door 16, and disconnect the wire harness from the refrigerator wire harness. The ice maker 20 is typically less than 12 inches×4 inches×6 inches (305 mm×102 mm×152 mm) and preferably is 10.6 inches×3.5 inches×5.25 inches (269.2 mm×88.9 mm×133.4 mm).

In operation, the ice maker 20 may begin an ice making cycle when a controller in electrical communication with the sensor or ice level input measuring system or device detects that a predetermined ice level is not met. In one embodiment, a bail arm 98 attached to a position sensor is driven, operated or otherwise positioned into the ice storage bin 54. If the bail arm 98 is prevented from extending to a predetermined point within the ice storage bin 54, the controller reads this as "full", and the bail arm 98 is returned to its home position. If the bail arm 98 reaches at least the predetermined point, the controller reads this is as "not full." The ice in the ice tray 28 is harvested as described in detail below, and the ice tray 28 is then returned to its home position, and the ice making process as described in detail below may begin. In alternative embodiments, the sensor may also be an optical sensor, or any other type of sensor known in the art to determine whether a threshold amount of ice within a container is met. The sensor may signal to the controller, and the controller may interpret that the signal indicates that the threshold is not met.

Figure 10A:
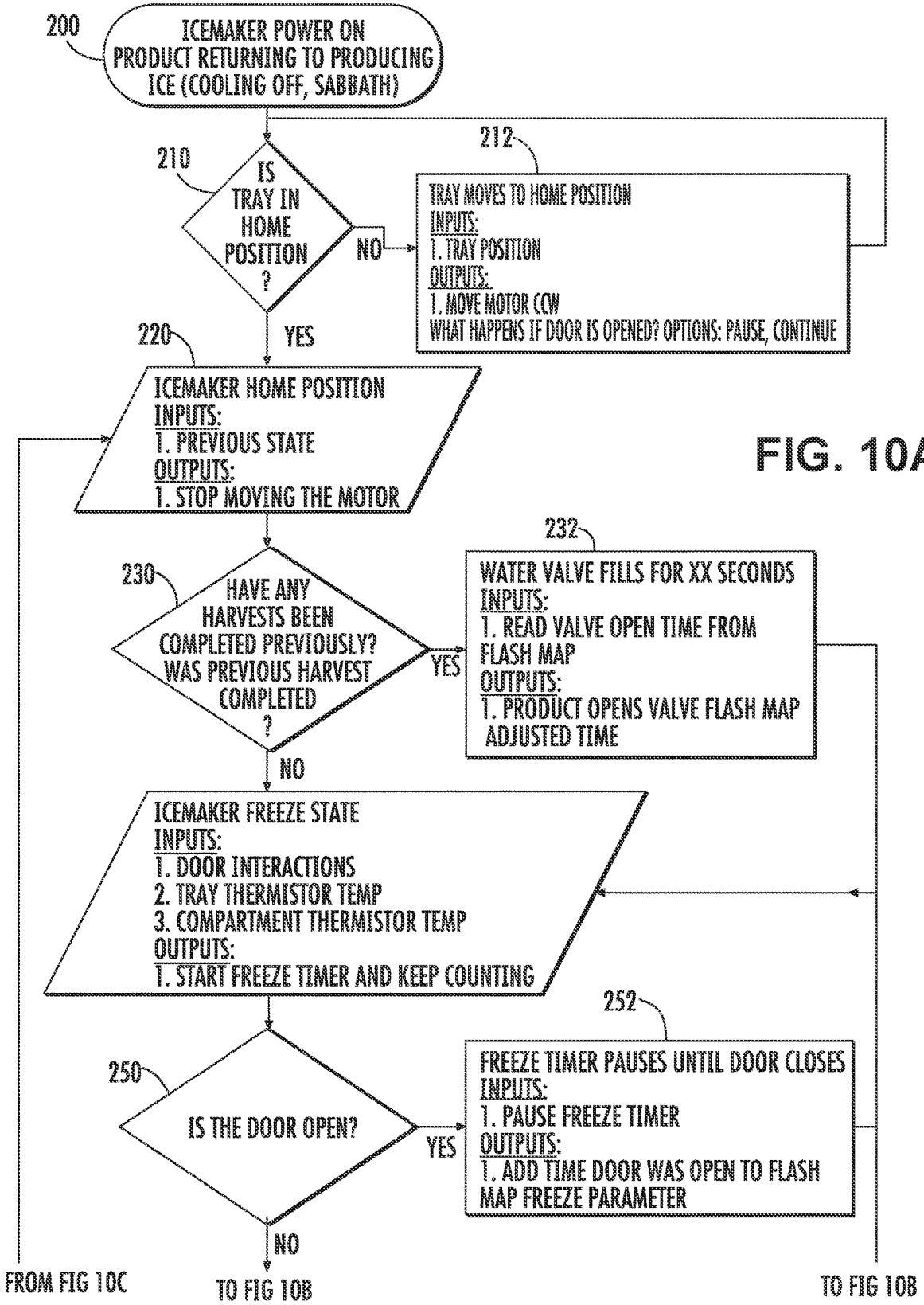
FIGS. 10A-10C are block diagrams of the typical ice making process.
Figure 10B:
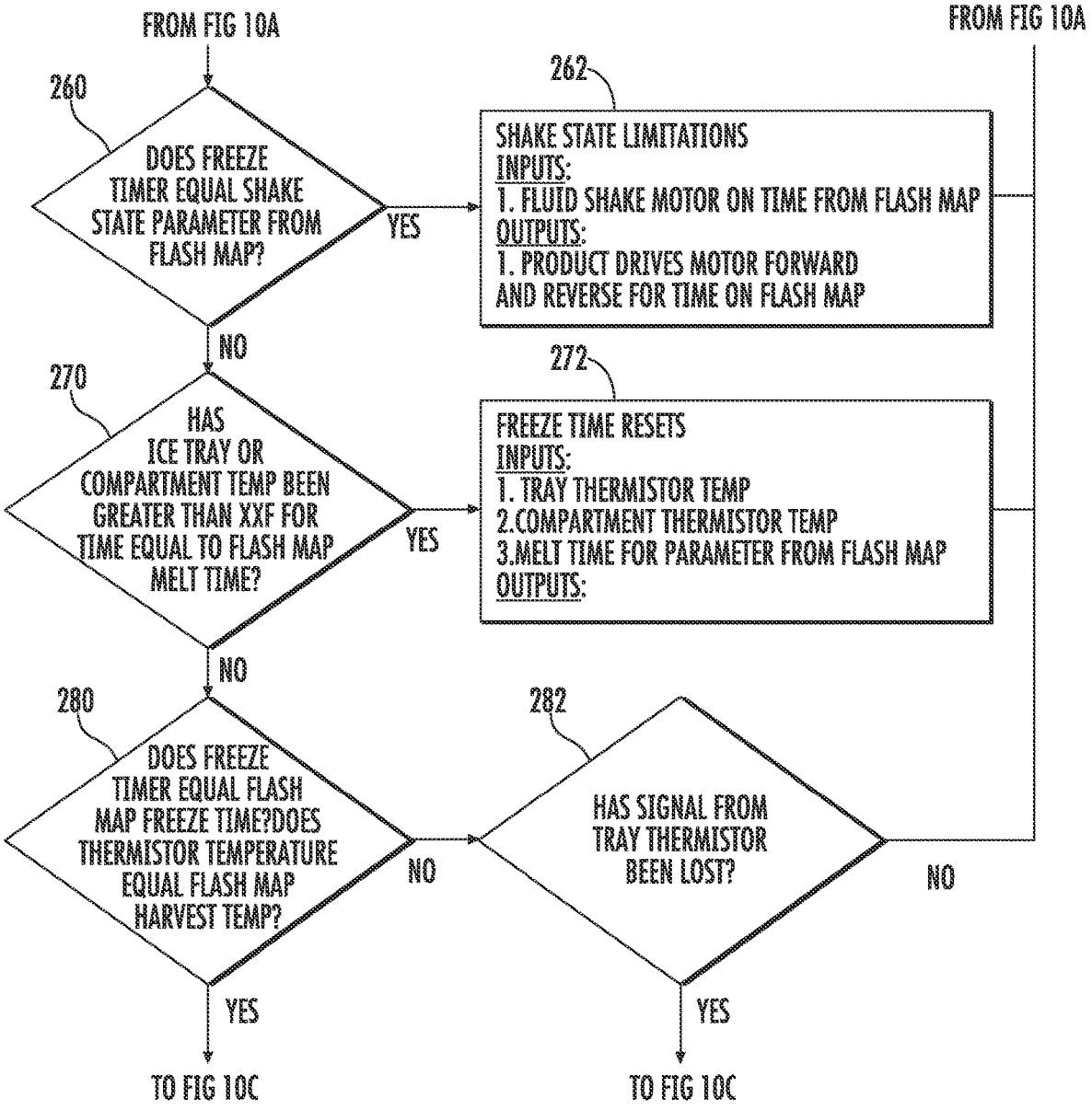
Figure 10C:
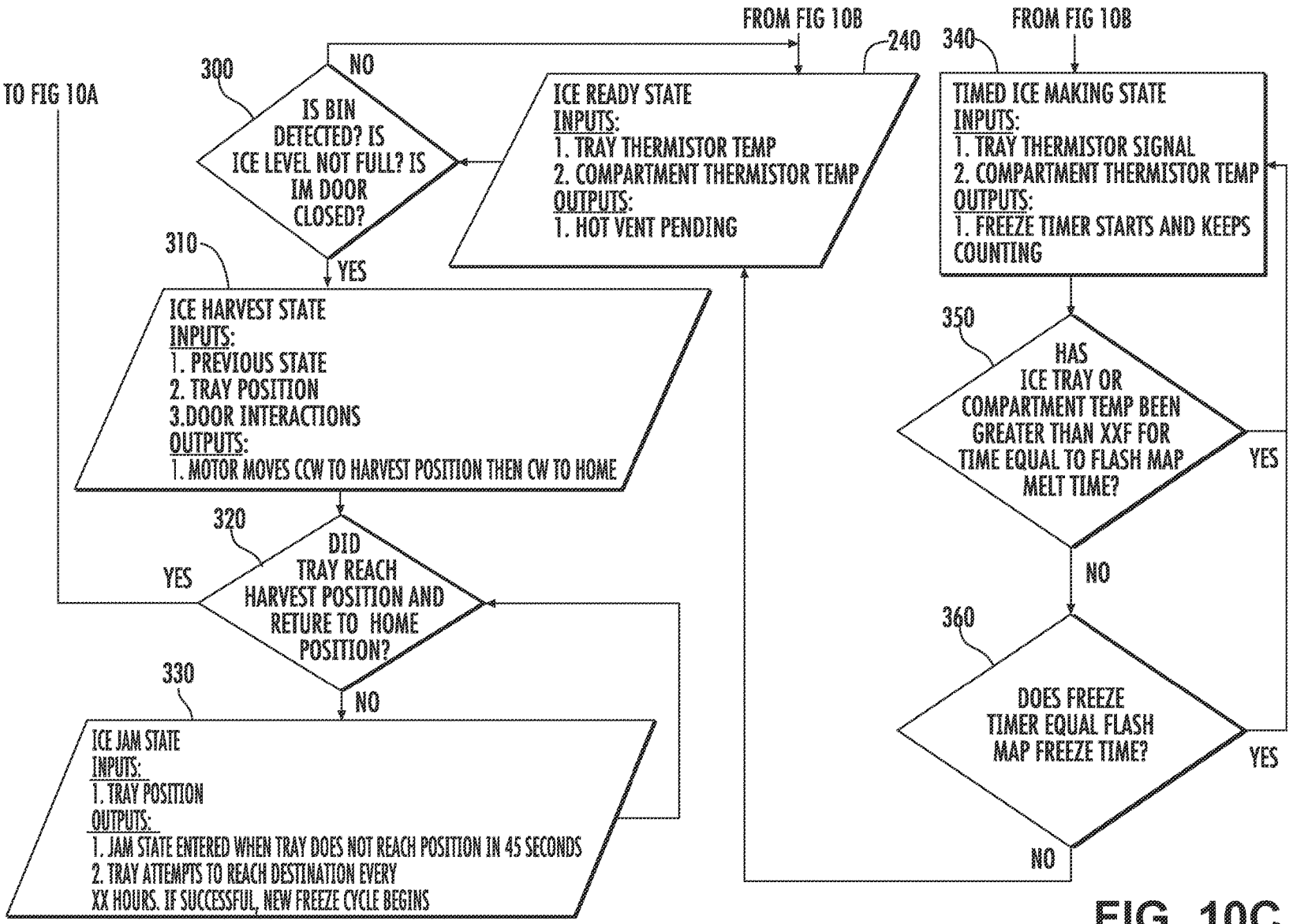

FIGS. 10A-10C detail the typical icemaking process. When power is restored to the icemaker as shown in step 200, the ice maker 20 checks whether the ice tray 28 is in home position, as shown in step 210, and as typically exemplified in FIGS. 4A and 4B. Step 212 shows what happens if the ice tray 28 is not in its home position, typically the controller sends a signal to the motor 24 to rotate the ice tray 28 back to its home position. Once the ice tray 28 is determined to be in its home position, as shown in step 230, the controller determines whether any previous harvests were completed. If the previous harvest was completed as shown in step 232, the controller will typically send an electrical signal to open a valve in fluid communication with the ice maker 20. Either after a predetermined amount of valve open time or when the controller senses that a predetermined amount of water has been delivered to the ice tray 28, a signal will be sent by the controller to the valve to close the valve and stop the flow of water. The predetermined amount of water may be based on the size of the ice tray 28 and/or the speed at which a user would like ice to be formed, and may be set at the point of manufacture or based on an input from a user into a user interface 15. Preferably, depending upon the design of the ice tray 28, the amount of water will typically be greater than 100 mL. Ideally, the predetermined amount may be about 110 mL, but may be as high as 150 mL. The amount of water may be between about 100 mL and about 150 mL. The valve will open, allowing water to flow out of the water outlet into the ice tray 28. The valve will stay open typically between 7-10 seconds, ideally for about 7 seconds. The water outlet may be positioned above the ice tray 28, such that the water falls with the force of gravity into the ice tray 28. The water outlet may be positioned over the middle of the ice tray 28, or it may be positioned over the ice wells 38 adjacent the first end 30 or the second end 32.

After step 232, or if in step 230, the controller determines that the previous harvest was not completed, the freeze timer typically is started and air at a temperature below the freezing point of water is forced from the freezer compartment 14 to the ice maker 20. The air may be forced by fan or any other method of moving air known in the art. The air is directed from the freezer 14 to the ice maker 20 via a duct or a series of ducts as discussed above, that lead from an inlet in the freezer compartment 14, through the insulation of the refrigerator 10, and to an outlet in the fresh food compartment 12 adjacent the ice maker 20. This air, which is typically at a temperature below the freezing point of water, is directed through the ice maker supply duct 82 of the ice maker 20 past the deflectors 76 into at least substantially even distribution over the ice wells 38 containing ice tray 28 to freeze the water within the ice wells 38 into ice pieces.

During the freezing process in step 240, the controller typically determines if a door 16 of the refrigerator 10 has been opened, as shown by step 250. If the door 16 is determined to be open at any time, the freeze timer is paused until the door 16 of the refrigerator 10 is closed, as shown by step 252. After some time, substantially all or all of the water will be frozen into ice. The controller may detect this by using the first thermistor 106 located on the underside of the ice tray 28 and in thermal contact with the ice tray 28. During the freezing process in step 240, the controller also typically determines if the temperature of the ice tray 28 or the temperature within the ice compartment is above a certain temperature for a certain amount of time, as shown by step 270. This temperature is typically between 20° F.-30° F., and more typically about 25° F. The typical time above that temperature is typically about 5-15 minutes, and ideally about 10 minutes. If the controller determines that the temperature was above the specified temperature for longer than the specified time, the freeze timer typically resets.

As shown in step 280, when the freeze timer reaches a predetermined time, and when the first thermistor 106 sends an electrical signal to the controller that a predetermined temperature of the ice tray 28 is met, the controller may read this as the water is frozen, and it typically begins the harvesting process, and the process moves forward to step 290. As shown in step 300, the controller first will ensure that an ice storage bin 54 is in place below the ice tray 28 to receive the ice cubes. The ice maker 20 may have a proximity switch that is activated when the ice storage bin 54 is in place. The ice maker 20 may also utilize an optical sensor or any other sensor known in the art to detect whether the ice storage bin 54 is in place.

Figure 8:
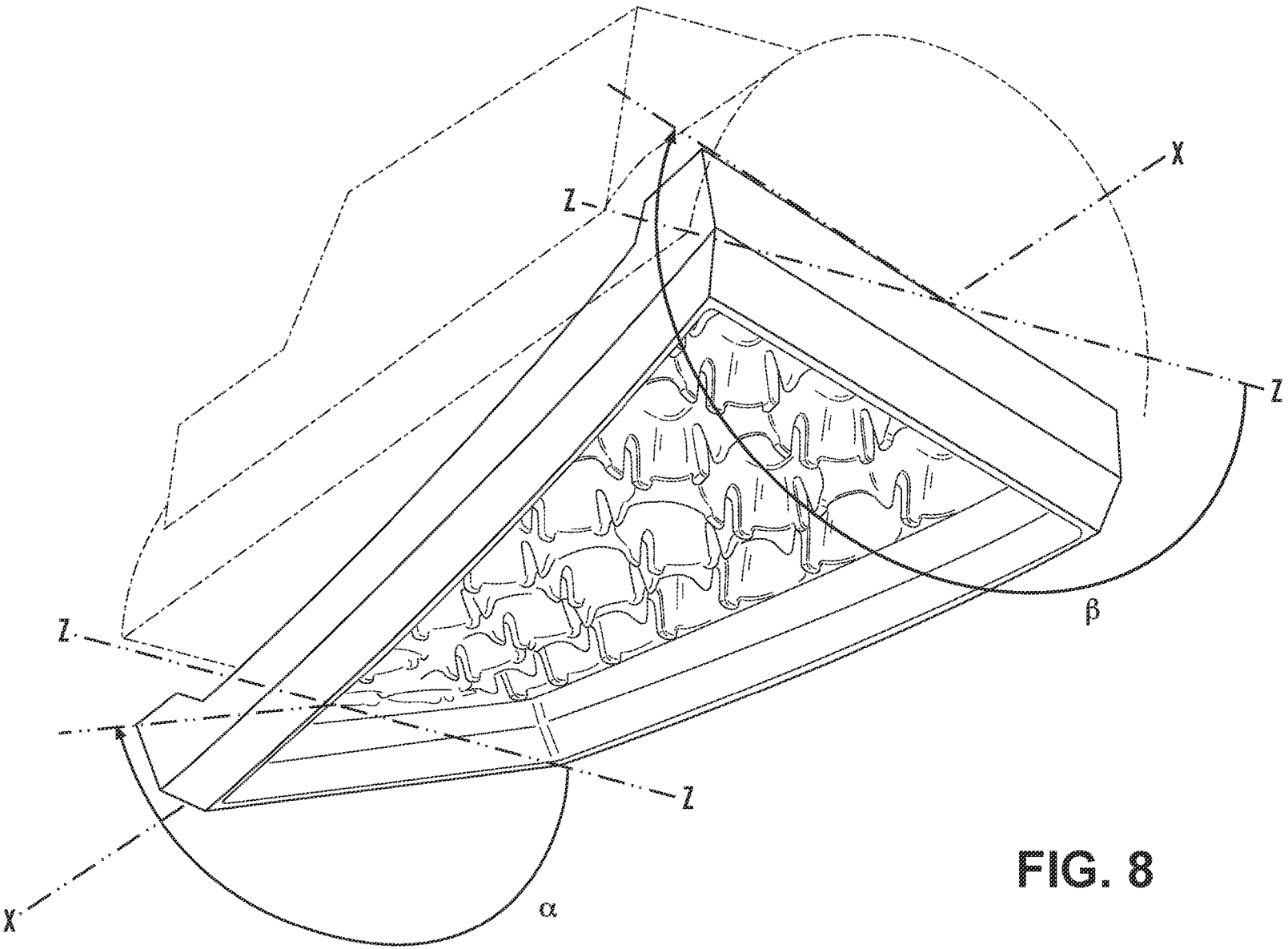
FIG. 8 is an isometric perspective view showing the twist motor of an ice tray according to an aspect of the present disclosure.
Figure 9A:
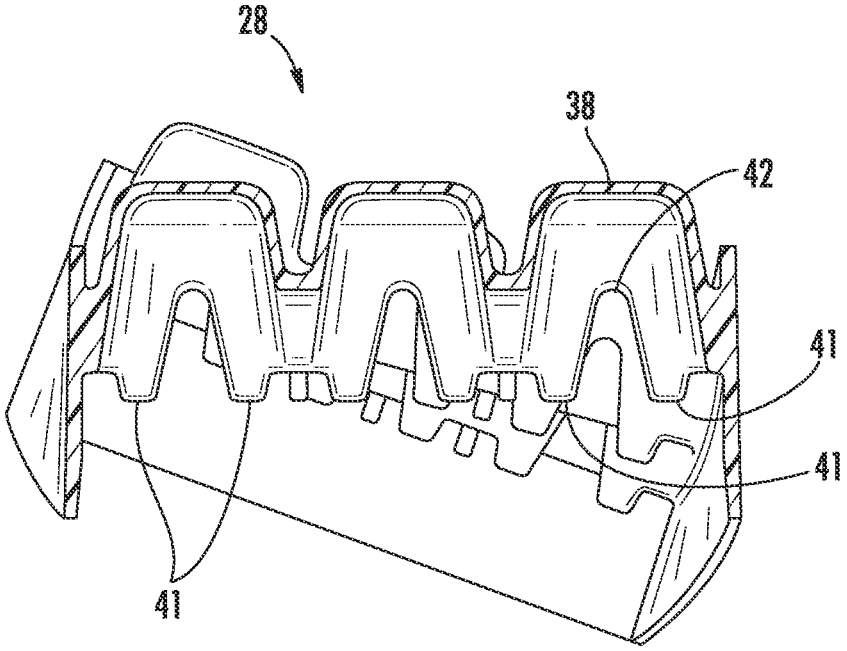
FIG. 9A is a cross-section of an ice tray in a twisted configuration taken along line 9A-9A in FIG. 8.
Figure 9B:
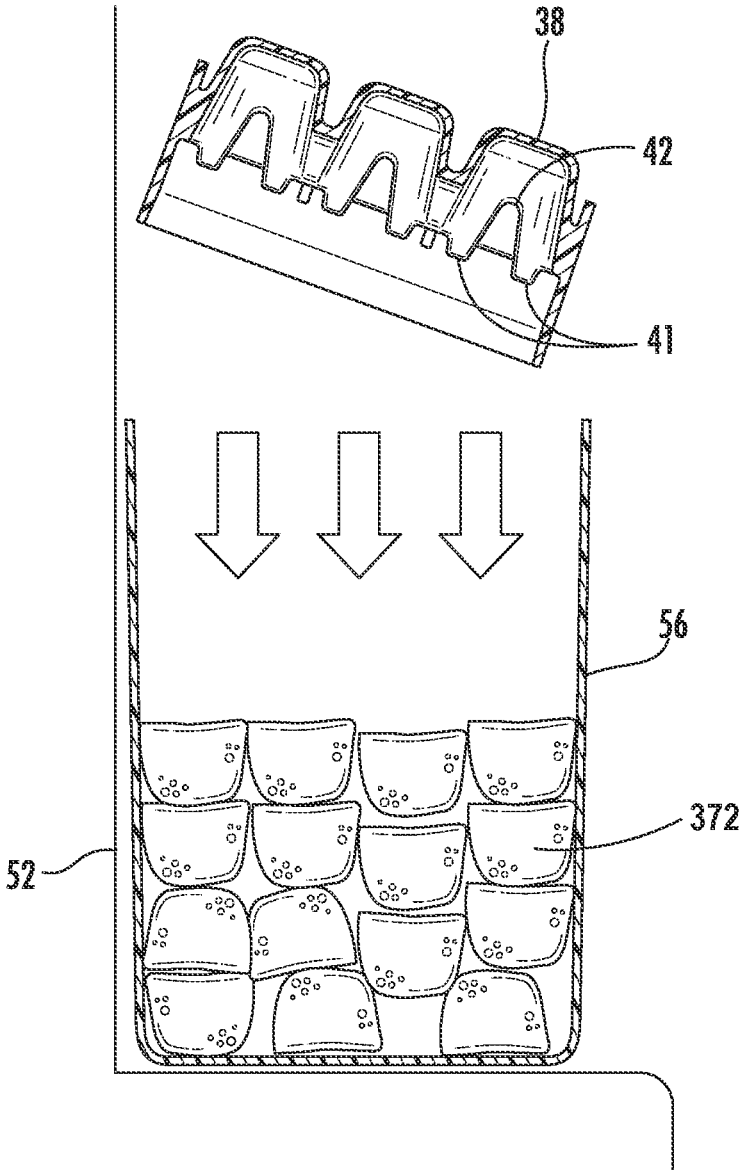
FIG. 9B is a cross-section through an end of an overall ice maker and ice bin portion of a refrigerator showing an ice tray and the ice bin showing the substantially level ice storage within the ice bin due at least in part to the methods of dispensing and the ice maker and ice tray according to an embodiment of the disclosure.

As shown by step 310, when the controller receives a signal that the ice storage bin 54 is in place, it will send a signal to the motor 24 to begin rotating about the axis of rotation X-X, as shown in FIG. 8, such that the ice tray 28 is substantially inverted, as shown in FIGS. 9A and 9B. As the motor 24 begins rotating, the ice tray 28, which is rotationally engaged with the motor at the first end 30, rotates with it. The ice tray 28 typically begins at a substantially horizontal and upright position Z-Z. The motor 24 rotates the entire ice tray 28 to an angle $\alpha$ (See FIG. 8) such that the ice tray 28 is substantially inverted. When the motor 24 and tray reach angle $\alpha$, the second end 32 of the ice tray 28 may be prevented from rotating any further by a bracket stop 100 on the bracket 22 (See FIG. 4A). With the second end 32 held in place by the bracket stop 100, the motor 24 continues to rotate the first end 30 of the ice tray 28 to an angle $\beta$. By continuing to rotate the first end 30, a twist is induced in the ice tray 28. The twist angle $\theta$ is an angle defined as:

$$\theta=\beta-\alpha$$

The twist in the ice tray 28 induces an internal stress between the ice and the ice tray 28, which separates the ice from the ice tray 28. The twist angle θ may be any angle sufficient to break the ice apart into ice pieces 372 and also break the ice loose from the ice tray 28. As shown in FIGS. 9A and 9B, a unique feature of the ice member and ice tray 28 of the present disclosure is the ability to be rotated substantially upside-down and horizontal when dispensing ice pieces 372. The angle α is preferably greater than 150°, and ideally about 160°, and the angle β is preferably greater than 190° and ideally about 200°. The twist angle θ is preferably greater than 30°, and ideally about 40°.

Figure 9C:
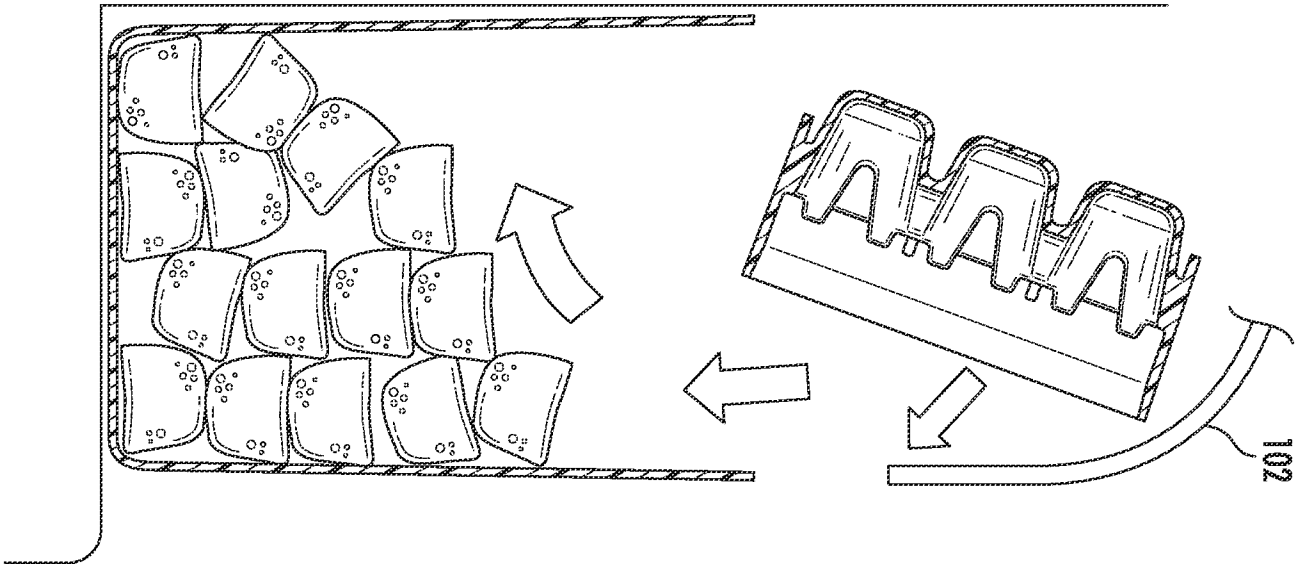
FIG. 9C (PRIOR ART)
FIG. 9C is a cross-section through a prior-art ice bin showing how it accumulates in an uneven fashion.

By rotating the ice tray 28 to a position substantially horizontal with the ice facing downward into the ice storage bin 54 before inducing the twist, the ice may be dropped in a substantially uniform and even configuration into the ice bin 54 as shown in FIG. 9B. In this manner, more complete ice dispensing is achieved. Dropping ice uniformly into the ice bin 54 avoids ice build up on one side of the ice storage bin 54, which could lead to a situation where a sensor indicates that the ice storage bin 54 is full when only half of the ice storage bin 54 is full, or vice versa, as shown in a prior art example of FIG. 9C. This enables more ice to be disposed and stored within the ice storage bin 54. Additionally, by rotating the ice tray 28 to be substantially horizontal and inverted, the ice maker 20 may harvest the ice pieces 372 without the use of a bumper 102 as shown in the prior art example of FIG. 9C. As is generally known in the art, a bumper 102 or ice guide aids ice to fall into an ice storage bin 54 or ice bucket when the ice tray 28 is not rotated substantially horizontal, as some of the ice may spill into the fresh food compartment 12.

Referring again to FIGS. 8-9B and 10A-10C, after the rotation is complete, the motor 24 returns to its home position as indicated at lines Z-Z in FIG. 8. If the controller determines that the ice tray 28 reached the harvest position and is back to the home position, the cycle may begin again at step 210. The typical harvest cycle takes from about 100 minutes to about 120 minutes, most typically about or exactly 115 minutes to complete. As shown in step 330, if the controller determines that the ice tray 28 did not reach home position, it will re-attempt to move it back to the home position typically every 18-48 hours, and ideally every 24 hours.

If in step 280 the temperature measured by first thermistor 106 does not equal a specified predetermined temperature, the controller may determine if the signal from the first thermistor 106 has been lost. If the signal has not been lost, the process reverts back to step 240 and the harvest process is begun again. If the signal has been lost, the ice maker 20 typically turns to a time-based freezing process, as shown by step 340. As shown in steps 350 and 360, the controller will determine if the temperature of the ice tray 28 or ice compartment temperatures have been above 20° F.-30° F., typically 25° F. for 5-15 minutes, more typically about or exactly 10 minutes. If either of these have been met, the process reverts back to step 340 and the freezing process is restarted. Once a predetermined time has been met, the harvest process is begun at step 290.

It is presently believed, through experimentation, that using the disclosed design and process for the ice maker 20 of the present disclosure, surprisingly, is capable of producing more than 3.5 pounds of ice per 24-hour period, more typically above 3.9 pounds (or above about 3.9 pounds) per 24-hour period. This ice production rate is achieved during normal (unaltered) operation and not through activation of a "fast-ice" or a temporary ice making condition. It is also presently believed that using a "fast-ice" mode with the disclosed design and process may produce up to as much as about 4.3 lbs of ice per 24-hour period. This is a surprising and substantial improvement over other heaterless-tray systems that produce ice at a slower rate. As used in this disclosure, "fast-ice" mode is defined as a temporary mode specified by a user on a user interface 15 that will force a greater amount of cold air to the ice maker receiving space 52 and the ice maker 20 in order to speed up the freezing process.

Figure 11:
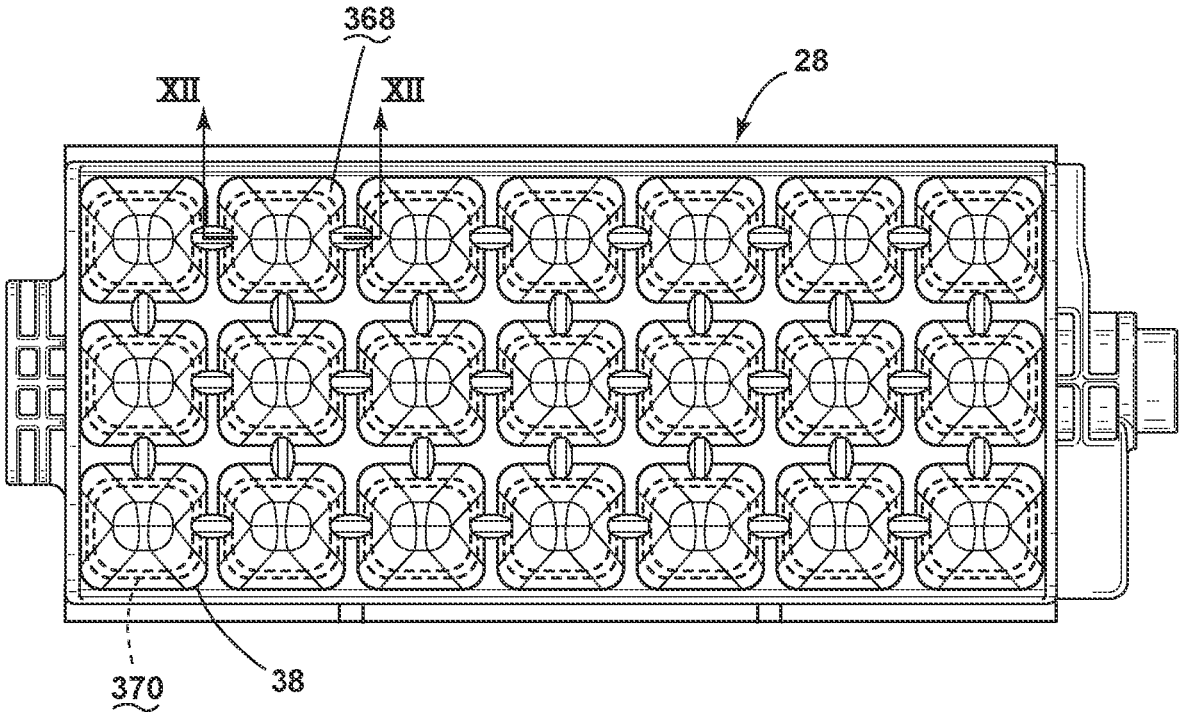
FIG. 11 is a top plan view of an aspect of an ice tray incorporating a textured ice-retaining portion.
Figure 12:
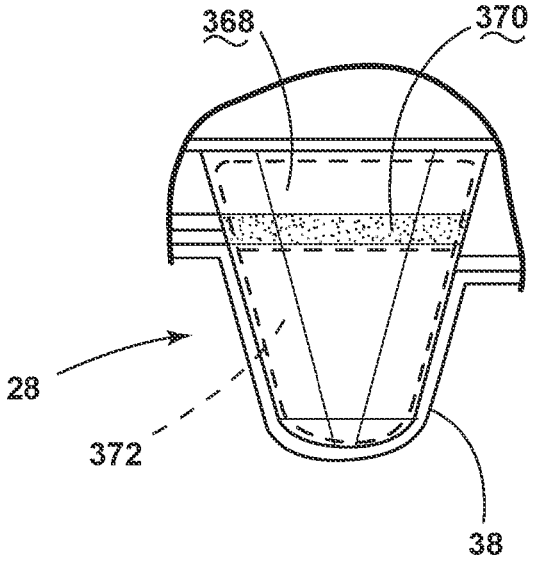
FIG. 12 is a cross-sectional view of the ice tray of FIG. 11 taken along line XII-XII.
Figure 13:
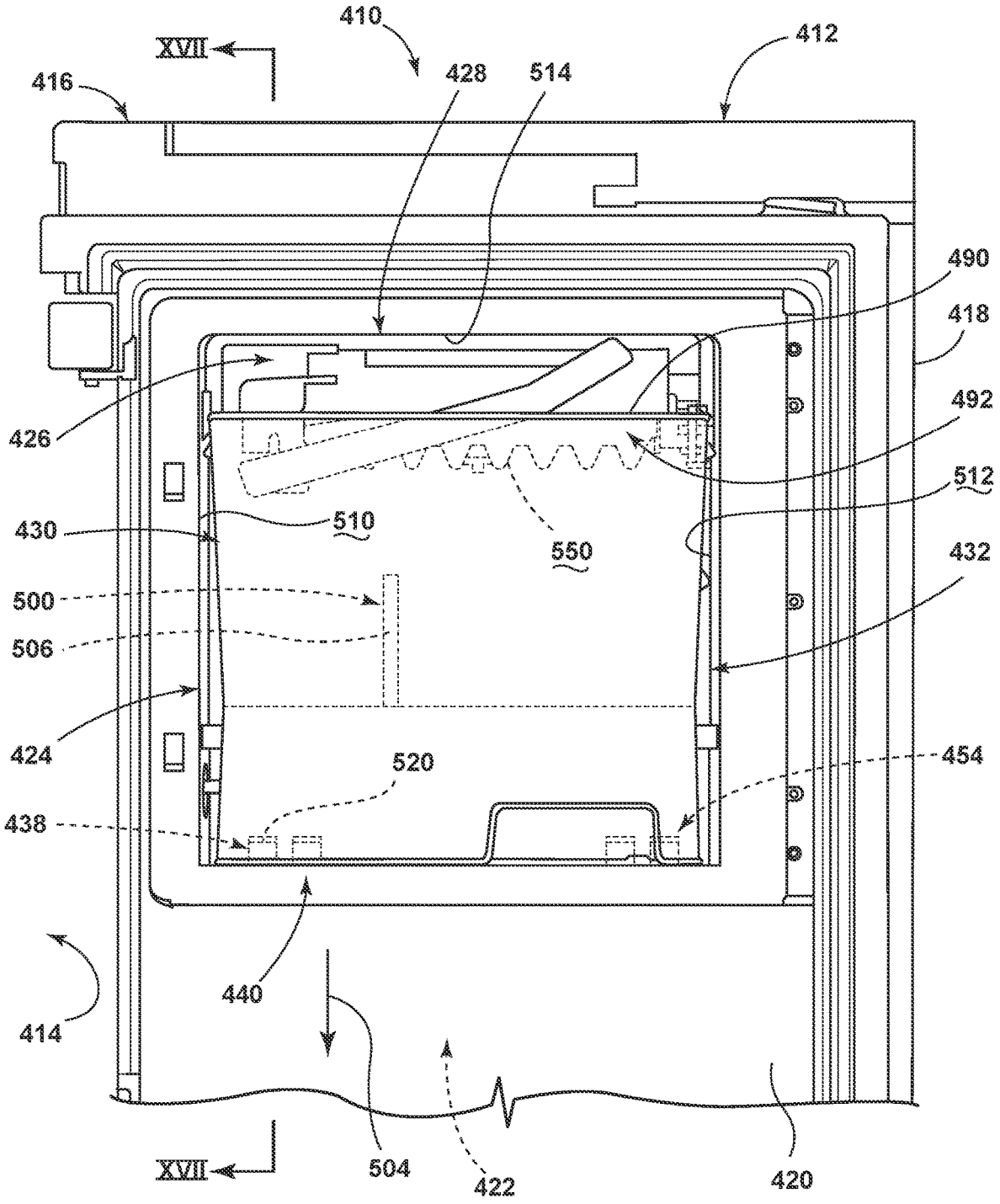
FIG. 13 is a front elevational view of the interior of the refrigerating appliance door illustrating an aspect of the ice storage bin in an engaged state.
Figure 14:
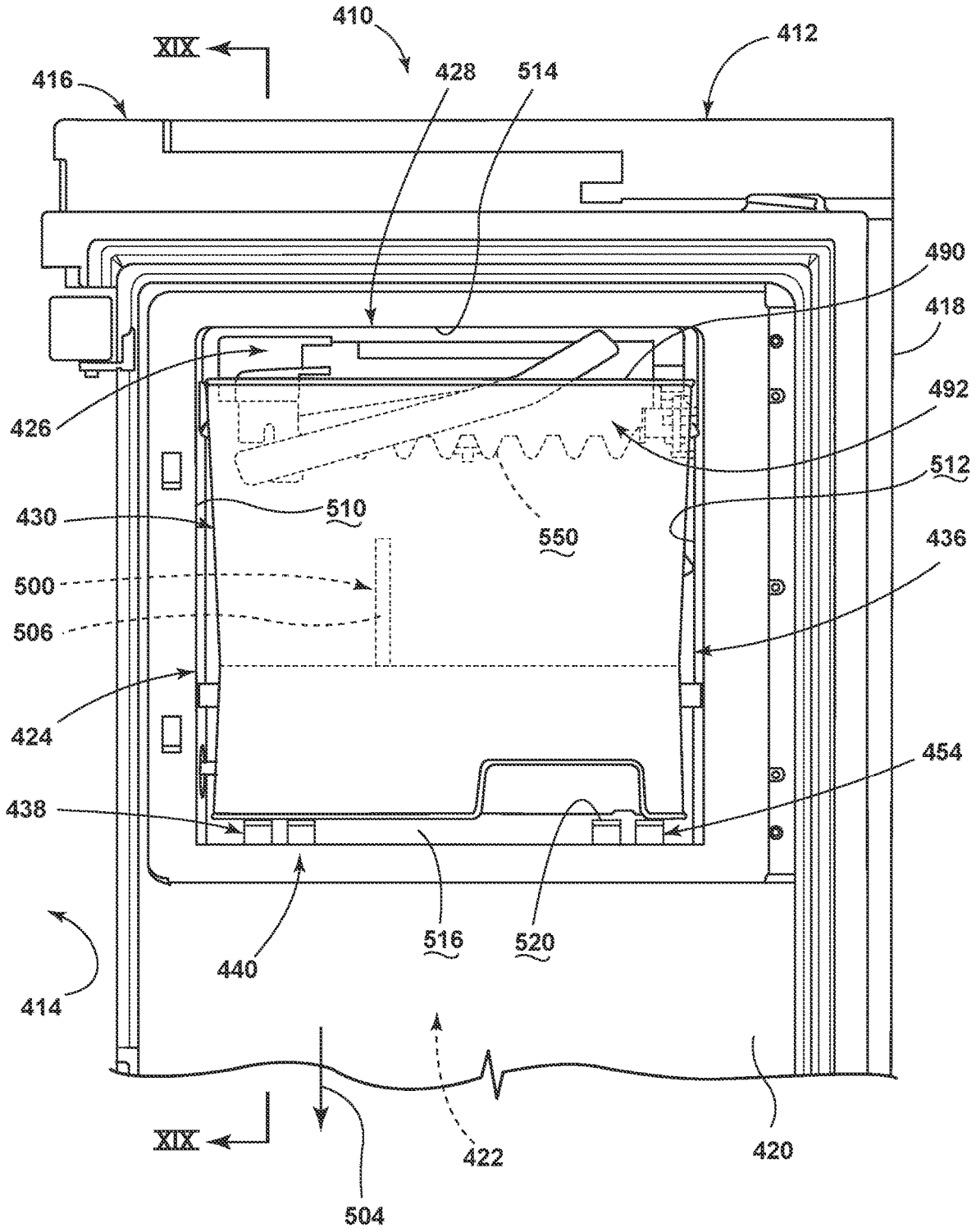
FIG. 14 is a front elevational view of the appliance door of FIG. 13 illustrating the ice storage bin in the sliding state.
Figure 15:
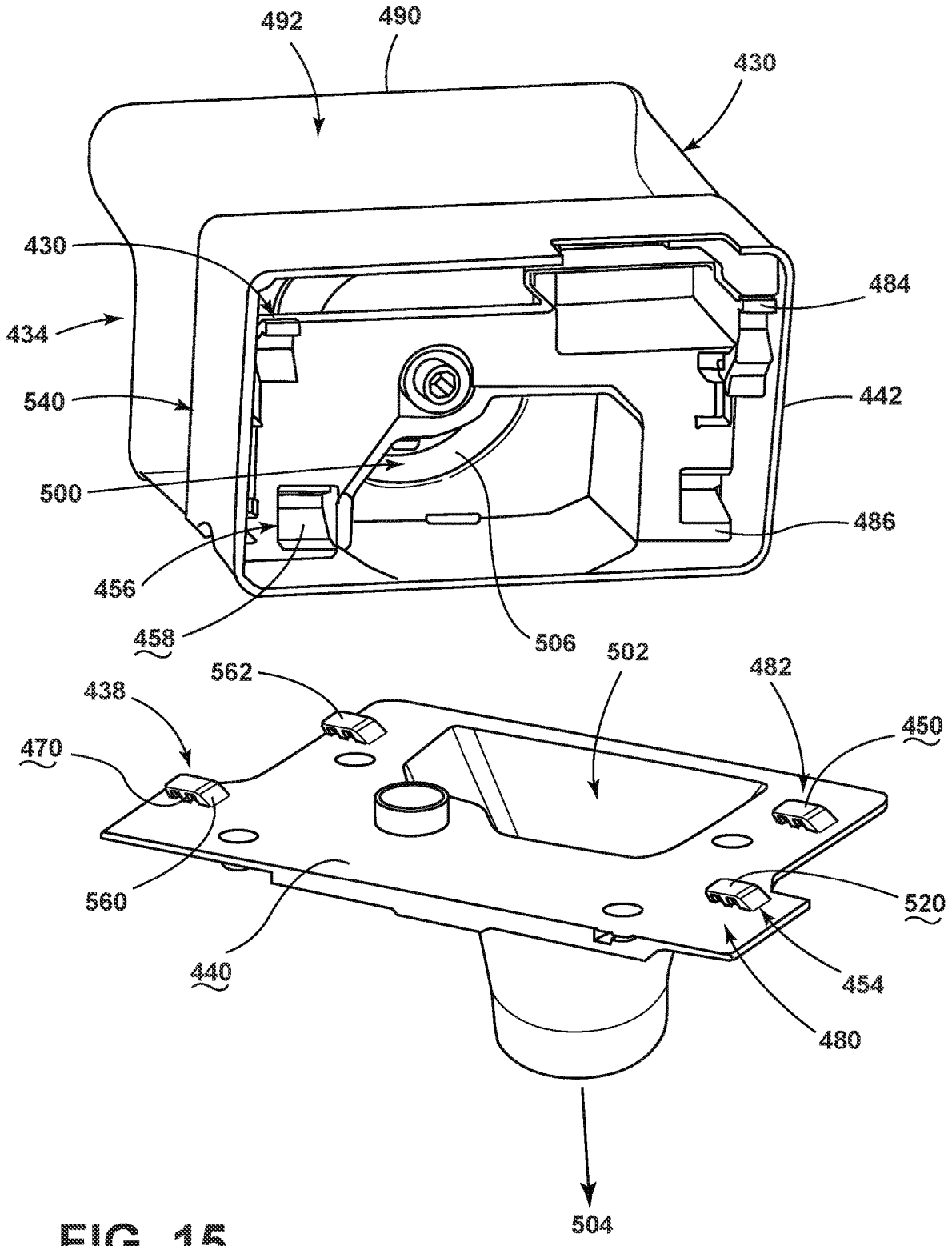
FIG. 15 is a partially exploded view illustrating an aspect of the ice storage bin separated from an aspect of a bottom surface of an ice making receptacle of an appliance door.
Figure 16:
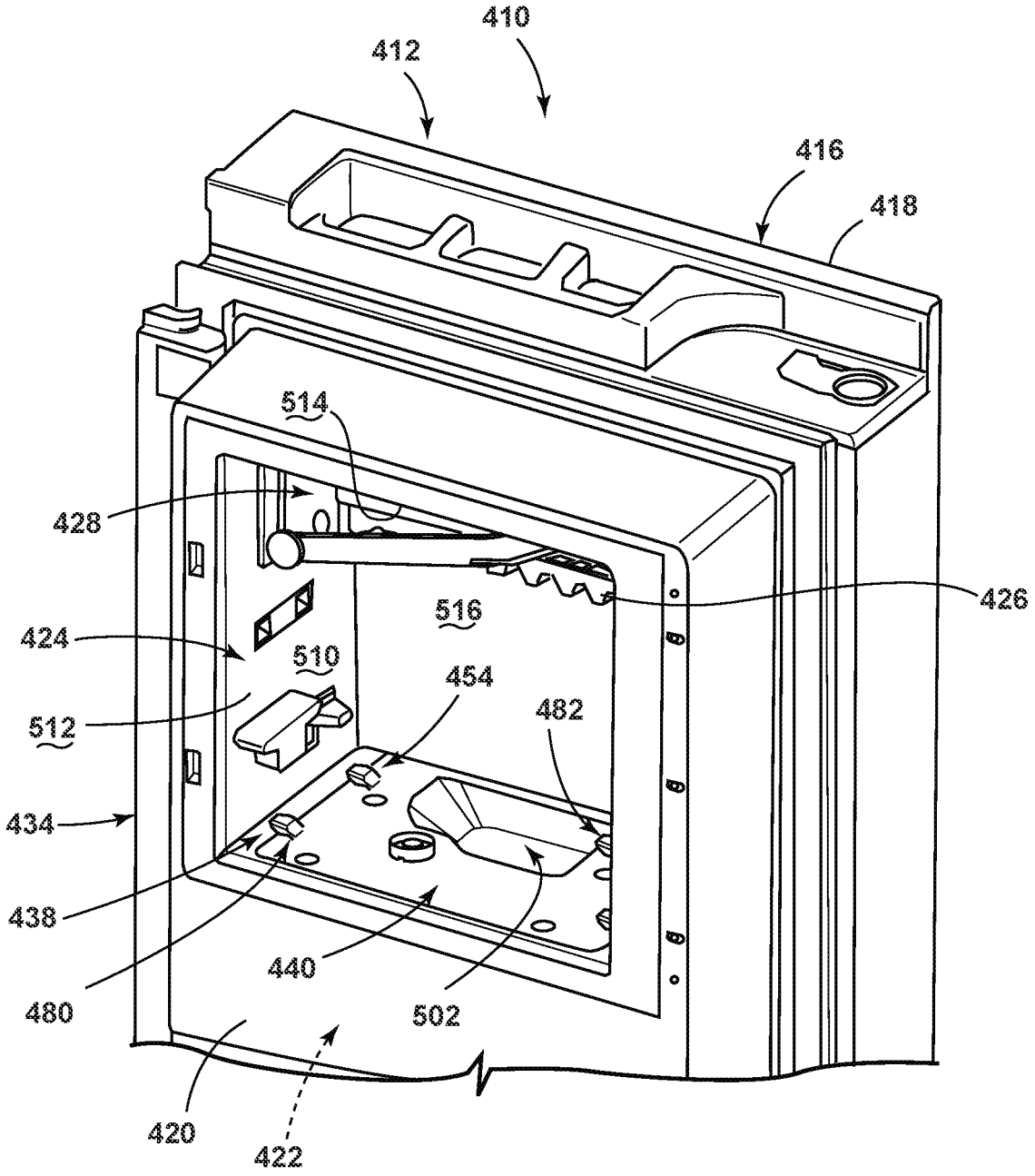
FIG. 16 is a front perspective view of the appliance door of FIG. 13 showing the ice storage bin in a disengaged state.
Figure 17:
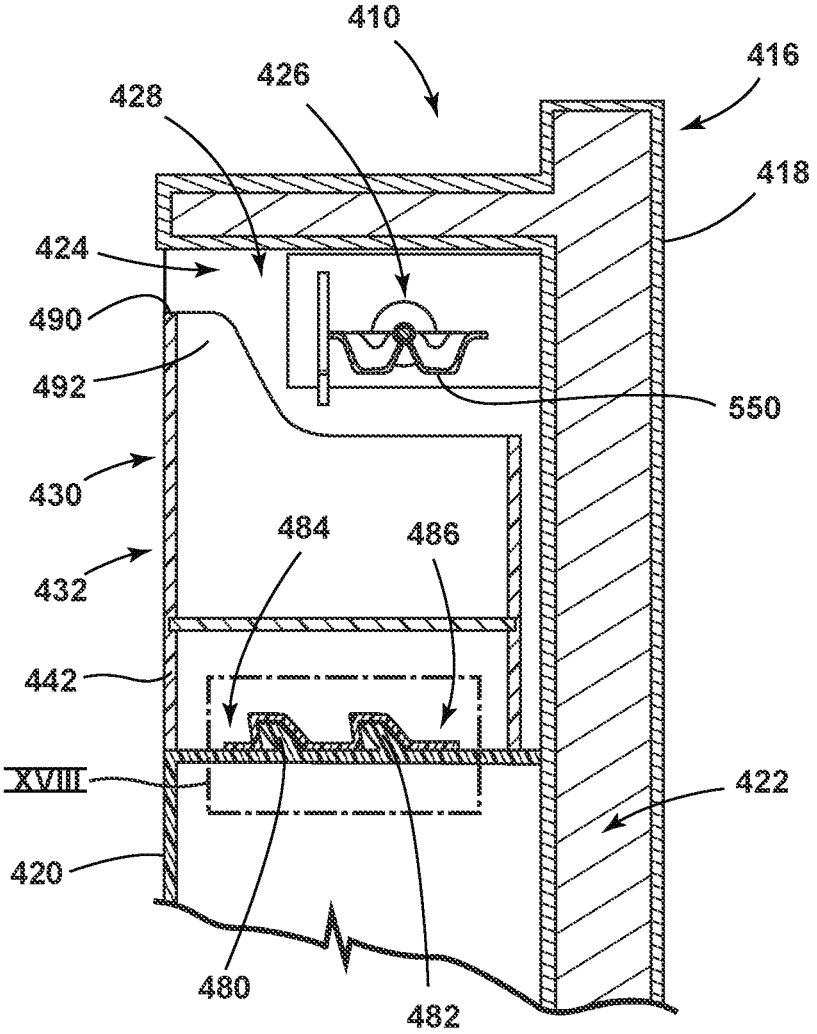
FIG. 17 is a cross-sectional view of the ice storage bin of FIG. 13 taken along line XVII-XVII.
Figure 18:
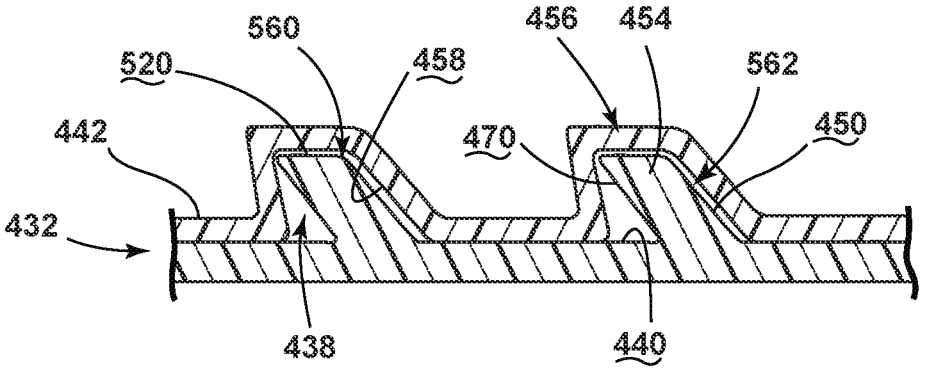
FIG. 18 is an enlarged cross-sectional view of the appliance door of FIG. 17 taken at area XVII-XVII.
Figure 19:
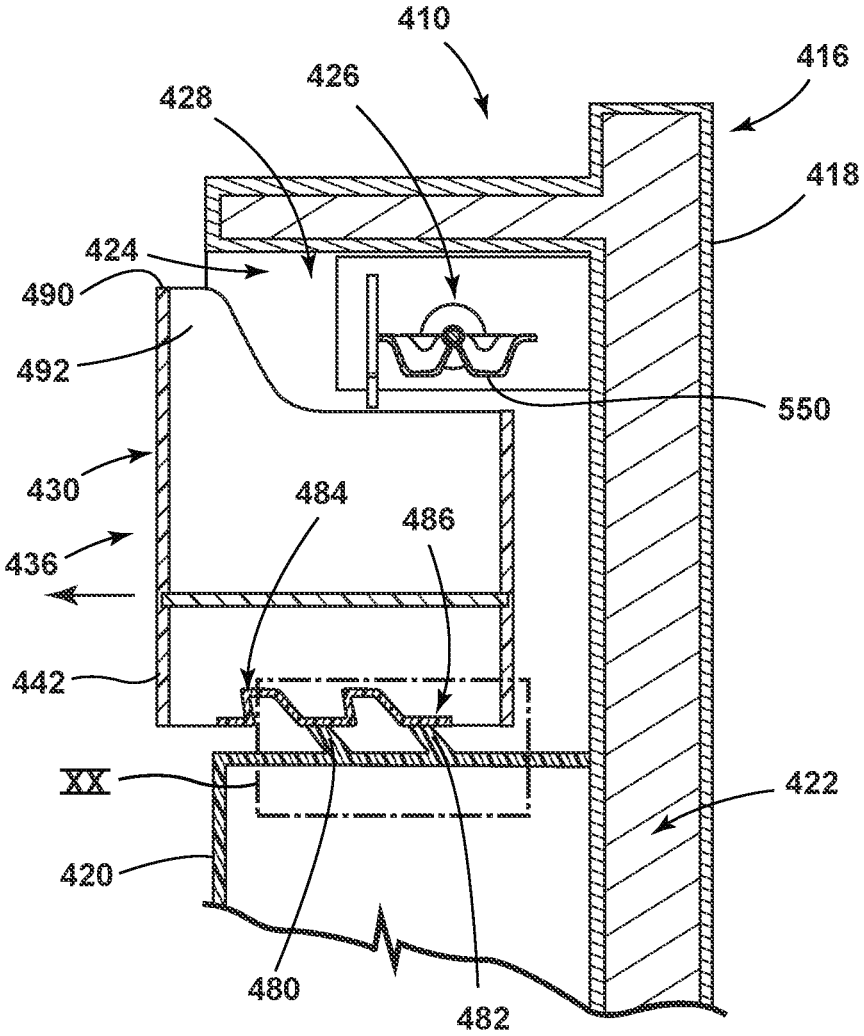
FIG. 19 is a cross-sectional view of the appliance door of FIG. 14 taken along line XIX-XIX.
Figure 20:
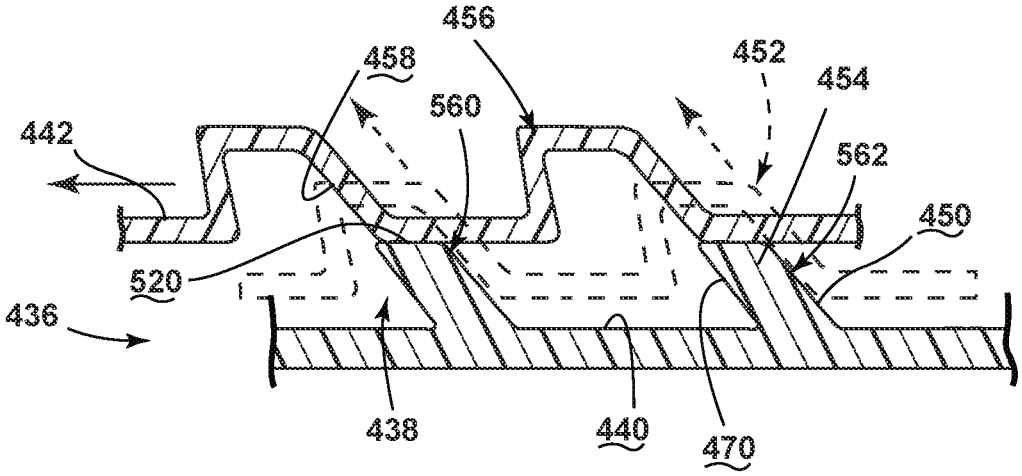
FIG. 20 is an enlarged cross-sectional view of the appliance door of FIG. 19 taken at area XX.

Referring now to aspects of the device as exemplified in FIGS. 11 and 12, each of the ice wells 38 of the ice tray 28 can include an inner facing surface 368 that defines a textured ice-retaining portion 370. It is contemplated that the textured ice-retaining portion 370 can serve to increase a coefficient of sliding friction between an ice piece 372 formed within the ice well 38 and the corresponding inner facing surface 368 of the ice well 38 in which the ice piece 372 was formed. It is contemplated that the textured ice-retaining portion 370 can add at least a minimal amount of retaining force between the ice piece 372 and the ice well 38, such that when the ice tray 28 is rotated to break apart and release the ice pieces 372, the ice pieces 372 can be retained within each ice well 38 at least partially by the textured ice-retaining portion 370 so that the twisting force applied to the ice tray 28 is more able to break apart the ice pieces 372. In this manner, the textured ice-retaining portion 370 can retain the ice pieces 372 within the corresponding ice well 38 to cause better breakage of the individual ice pieces 372 and to avoid clumping of multiple ice pieces 372 that may be deposited within the ice storage bin 54. Such a condition, where certain numbers of ice pieces 372 remain unbroken from one another, can negatively impact the operation of the ice dispensing mechanism 374 of the refrigerator 10.

Referring again to FIGS. 11 and 12, it is contemplated that the textured ice-retaining portion 370 of the inner facing surface 368 of each ice well 38 can at least partially increase an angle of repose of each ice piece 372 with respect to the inner facing surface 368 of the corresponding ice well 38. In this manner, when the ice tray 28 is twisted in a substantially inverted position (exemplified in FIGS. 9A and 9B) such that at least one of the ice wells 38 is inverted and substantially horizontal with respect to a base 56 of the ice storage bin 54, the increased critical angle of repose between the ice piece 372 and the corresponding ice well 38 can cause the ice piece 372 to be retained within the ice well 38 for an additional minimal period of time, so that the ice piece 372 can be disengaged from the ice well 38 and dropped substantially vertically into the ice storage bin 54. Such a configuration can promote even disposition of the ice pieces 372 from the ice tray 28 and into the ice storage bin 54.

According to the various embodiments, it is contemplated that the textured ice-retaining portion 370 of each of the ice wells 38 can be defined by at least a portion of the inner facing surface 368 of the ice well 38 having scoring, ripples, dimples, etching, recesses, protrusions, combinations thereof, or other similar surface texture that can serve to increase the coefficient of sliding friction and/or the critical angle of repose between the ice piece 372 and the corresponding ice well 38. It is also contemplated that the textured ice-retaining portion 370 can be defined by the entire inner facing surface 368 of the ice well 38, or can be defined by a portion of the inner facing surface 368 of the ice well 38. The size of the textured ice-retaining portion 370 can be determined based upon various factors that can include, but are not limited to, the size of each ice well 38, the number of ice wells 38 in the ice tray 28, the size of the various weirs 40 defined between the various ice wells 38, the material of the ice tray 28, and other similar design factors and considerations.

According to the various embodiments, the configuration of the textured ice-retaining portion 370 is designed to allow for efficient breakage of the various ice pieces 372 and disposal of each of the ice pieces 372 into the ice storage bin 430. Simultaneously, the configuration of the textured ice-retaining portion 370 is configured to not interfere or substantially interfere with the proper operation of the ice maker 20 disclosed herein. Accordingly, the textured ice-retaining portion 370 should be textured enough to at least partially retain the ice pieces 372 in each of the ice wells 38 during twisting of the ice tray 28 to break apart the ice pieces 372 and also during a portion of the rotating phase. However, the textured ice-retaining portion 370 is not so textured that it retains the ice pieces 372 within the corresponding ice well 38 after the first end 30 of the ice tray 28 has been fully rotated by the motor 24. It is contemplated that the ice tray 28 can include a supplemental ejection mechanism that is configured to vibrate the ice tray 28 by tapping, striking or otherwise shaking a portion of the ice tray 28 to remove any ice pieces 372 that may remain within the various ice wells 38, to insure that when the ice tray 28 is returned to the home position, the ice pieces 372 have been removed, or substantially removed, from the ice tray 28.

Referring now to the various embodiments of the device as exemplified in FIGS. 13-20, new figure numbers have been incorporated into this portion of the disclosure. However, the presence of new figure numbers does not exclude the potential combination of the subject matter to follow from that previously disclosed herein. Accordingly, embodiments of the device as disclosed throughout the application can be combined with any one or more of other or alternate aspects or embodiments of the device as exemplified herein, either explicitly or implicitly.

According to the various aspects of the device as exemplified in FIGS. 13-20, the refrigerating appliance 410 can include a cabinet 412 that defines an interior compartment 414. An appliance door 416 is attached to the cabinet 412 and is selectively operable to at least partially enclose the interior compartment 414. The appliance door 416 can include an outer wrapper 418, an inner liner 420 and an interior space 422 defined between the outer wrapper 418 and the inner liner 420. The inner liner 420 is configured to define an ice making receptacle 424 that can extend inward through at least a portion of the interior space 422 and toward the outer wrapper 418. According to the various embodiments, an ice maker 426 is at least partially disposed within a top portion 428 of the ice making receptacle 424. An ice storage bin 430 is disposed within the ice making receptacle 424 and is positioned below the ice maker 426 to define an engaged state 432. The ice storage bin 430 is operable between the engaged state 432 and a disengaged state 434 via a sliding state 436. The engaged state 432 is defined by the ice storage bin 430 being fully inserted into the ice making receptacle 424 and under the ice maker 426. The disengaged state 434 is defined by the ice storage bin 430 being removed from the appliance door 416, such that the ice storage bin 430 is also removed from the ice making receptacle 424. A sliding assembly 438 is positioned proximate a bottom surface 440 of the ice making receptacle 424. It is contemplated, in various embodiments, that the ice storage bin 430 is vertically operable from an engaged state 432 up to the sliding assembly 438 to define the sliding state 436. The ice storage bin 430, in the sliding state 436, is horizontally slidable through a portion of the ice-making receptacle 424 between the engaged state 432 and the disengaged state 434 such that a base 442 of the ice storage bin 430 remains substantially horizontal as the ice storage bin 430 is moved between the engaged and sliding states 432, 436.

While it is disclosed that the base 442 of the ice storage bin 430 remains substantially horizontal in each of the engaged and sliding states 432, 436, it is contemplated that the base 442 of the ice storage bin 430 is not rotated, or is rotated only minimally as the ice storage bin 430 is moved between the engaged and sliding states 432, 434. This configuration will be described more fully below.

Referring again to FIGS. 13-20, the sliding assembly 438 can include a ramped surface 450, wherein movement of the ice storage bin 430 along the ramped surface 450 of the sliding assembly 438 defines a transitional state 452, wherein the ice storage bin 430 is operable between the engaged state 432 and the sliding state 436. In this manner, the vertical operability of the ice storage bin 430 between the engaged state 432 and the sliding state 436 is accomplished as a portion of the ice storage bin 430 is slid along the ramped surface 450 of the sliding assembly 438. It is contemplated that the sliding assembly 438 can be defined by a plurality of tabs 454 that extend upward from the bottom surface 440 of the ice making receptacle 424. In this manner, each of the plurality of tabs 454 defines a portion of the ramped surface 450 of the sliding assembly 438. In order to provide the vertical movement of the ice storage bin 430 along the ramped surface 450, the base 442 of the ice storage bin 430 can include a plurality of tab receptacles 456 that engage and receive corresponding tabs 454 of the ice making receptacle 424. Each of the plurality of tab receptacles 456 can include a biasing surface 458 that slidably engages corresponding portions of the ramped surface 450 to define a transitional state 452 that vertically operates the ice storage bin 430 between the engaged state 432 and the sliding state 436.

Referring again to FIGS. 13-20, it is contemplated that each of the plurality of tabs 454 of the sliding assembly 438 can include a retaining surface 470 that can substantially oppose the corresponding portion of the ramped surface 450. Each of the retaining surfaces 470 is configured to at least partially engage a portion of a corresponding tab receptacle of a base 442 of the ice storage bin 430. In this manner, the retaining surfaces 470 of the plurality of tabs 454 substantially engages the base 442 of the ice storage bin 430 and substantially prevents or prevents unintentional movement of the ice storage bin 430 away from the engaged state 432.

Referring again to the various aspects of the device as exemplified in FIGS. 13-20, it is contemplated that the ice storage bin 430 is substantially free of rotational movement in both vertical and lateral directions, when the ice storage bin 430 is in the engaged state 432, the transitional state 452 and the sliding state 436. In order to accomplish this rotation-free movement, the sliding assembly 438 can be separated into front and rear portions 480, 482. It is contemplated that the front 484 of the ice storage bin 430 can rest upon and slide against a front portion 480 of the sliding assembly 438, and a rear 486 of the ice storage bin 430 can rest upon and slide against a rear portion 482 of the sliding assembly 438. Accordingly, as the ice storage bin 430 moves from the engaged state 432 and through the transitional state 452, the front and rear 484, 486 of the ice storage bin 430 slidably engages in a generally vertical direction, the front and rear portions 480, 482 of the sliding assembly 438, respectively. Accordingly, the front and rear 484, 486 of the ice storage bin 430 are elevated through the transitional state 452 such that the ice storage bin 430 does not rotate as it moves through the transitional state 452 to the sliding state 436. Conversely, when the ice storage bin 430 is returned to the engaged state 432, the front and rear 484, 486 of the ice storage bin 430 slidably engage and descend along the ramped surfaces 450 of the front and rear portions 480, 482 of the sliding assembly 438 to descend from the sliding state 436, through the transitional state 452, and back into the engaged state 432.

It is contemplated, in various embodiments, that the transitional state 452 can be defined by the ice storage bin 430 being operated in a lateral, arcuate, irregular, diagonal or other linear or substantially linear direction between the engaged and sliding states 432, 436. In such an embodiment, the ice storage bin 430 can be moved in a first linear direction that defines the transitional state 452, then the ice storage bin 430 can be moved in a second linear direction that defines the sliding state 436. It is contemplated that the first linear direction is different than the second linear direction. Accordingly, the first and second linear directions can cooperate to maneuver the ice storage bin 430 between the engaged and disengaged states 432, 434 and at least partially secure the ice storage bin 430 in the engaged state 432. Accordingly, the transitional state 452 can be defined by a generally vertical movement, either upward or downward, from the engaged state 432 to the sliding state 436. The transitional state 452 can also be defined by lateral movement between the engaged and sliding states 432, 436.

According to the various embodiments, it is contemplated that the use of the sliding assembly 438 and the ramped surface 450 can provide for minimal vertical movement of the ice storage bin 430 as the ice storage bin 430 is moved between the engaged and disengaged states 432, 434. In this manner, a top edge 490 of the ice storage bin 430 can be positioned a minimal distance below the bottom of the ice maker 426 to define the engaged state 432. Accordingly, a minimal amount of space is necessary to house both the ice maker 426 and the ice storage bin 430 within the ice making receptacle 424 of the appliance door 416. Additionally, this configuration allows for an upper portion 492 of the ice storage bin 430 to at least partially surround the ice maker 426 when the ice storage bin 430 is in the engaged state 432. As such, the upper portion 492 of the ice storage bin 430 can substantially prevent unwanted ejection of ice pieces 372 from the appliance door 416 during operation of the various ice harvesting processes disclosed herein.

Referring again to FIGS. 13-16, according to the various embodiments, the minimal space devoted for the ice maker 426 and the ice storage bin 430 can also house an ice delivery system 500 of the appliance door 416. In such an embodiment, the bottom surface 440 of the ice making receptacle 424 can be placed in communication with the ice delivery chute 502 that extends from the bottom surface 440 of the ice making receptacle 424 to an ice dispensing location 504. It is contemplated that the ice dispensing location 504 can be proximate the outer wrapper 418 of the appliance door 416 corresponding to a location exemplified at 15 in FIG. 1. It is also contemplated that the ice delivery chute 502 can extend toward a freezer compartment (shown in FIGS. 1 and 2 at 18) of the refrigerating appliance 410 for disposal of ice pieces 372 (exemplified in FIGS. 9B and 12) into an ice receptacle disposed within the freezer compartment 14 of the refrigerating appliance 410. The base 442 of the ice storage bin 430 can include an ice delivery mechanism 506, such as an auger, conveyor, or other similar ice delivery mechanism 506 that is configured to be selectively operable to deliver ice from within the ice storage bin 430 into the ice delivery chute 502. It is also contemplated that the ice storage bin 430 can include various ice manipulation features (not shown) where such ice manipulation features can include, but are not limited to, ice chopping features, ice shaving features, ice crushing features, combinations thereof, and other similar ice manipulation mechanisms.

Referring again to the various aspects of the device as exemplified in FIGS. 13-20, an appliance door 416 for the refrigerating appliance 410 can include the outer wrapper 418 and inner liner 420, wherein the inner liner 420 defines the ice making receptacle 424. It is contemplated that the sliding assembly 438 can be defined within an inward-facing surface 510 of the ice making receptacle 424. Such inward-facing surface 510 can include the bottom surface 440, side surfaces 512, top surface 514, back surface 516, or other inward-facing surface 510 of the ice making receptacle 424. While FIGS. 13-20 exemplify the sliding assembly 438 extending from the bottom surface 440 of the ice making receptacle 424, it is contemplated that other positions of the sliding assembly 438 are contemplated, among the various embodiments, as described above. The ice storage bin 430 can be operable between the engaged state 432, the disengaged state 434, and the lateral sliding state 436, wherein the ice storage bin 430 is operated laterally and free of rotation between the engaged and disengaged states 432, 434. It is contemplated that the ice storage bin 430 and ice making receptacle 424 can cooperatively define the ice delivery mechanism 506 that selectively delivers ice pieces 372 from an inner volume of the ice storage bin 430 to an ice dispensing location 504 of the refrigerating appliance 410, such as proximate the outer wrapper 418 or in another portion of the interior compartment 414 of the refrigerating appliance 410.

Referring again to FIGS. 16-20, it is contemplated that the sliding assembly 438 can define a lateral sliding surface 520 upon which a portion of the ice storage bin 430 can slide to define the sliding state 436. The lateral sliding surface 520, according to the various aspects of the device, can be vertically offset and/or parallel with the bottom surface 440 of the ice making receptacle 424. As described above, this configuration where the lateral sliding surface 520 is substantially parallel with the bottom surface 440 of the ice making receptacle 424 allows for the movement of the ice storage bin 430 from the engaged state 432 and toward the disengaged state 434 without rotating the ice storage bin 430 or substantially rotating the ice storage bin 430.

Referring again to FIGS. 16-20, the sliding assembly 438 can at least partially define the ramped surface 450 that corresponds to the transition state of the ice storage bin 430. It is contemplated that the sliding movement of the ice storage bin 430 along the ramped surface 450 of the sliding assembly 438 can vertically operate the ice storage bin 430 between the engaged and sliding states 432, 436. Through this vertical and lateral movement through the transitional and sliding states 452, 436, the base 442 of the ice storage bin 430 is configured to remain substantially parallel with the bottom surface 440 of the ice making receptacle 424. As discussed herein, in various embodiments, the base 442 of the ice storage bin 430 may not be parallel with the bottom surface 440 of the ice making receptacle 424. In such an embodiment, the base 442 of the ice storage bin 430 is configured to move within a single plane or parallel with the single plane as the ice storage bin 430 is operated between the engaged, transitional, sliding and disengaged states 432, 452, 436, 434.

It is also contemplated, in various embodiments, that the base 442 of the ice storage bin 430 may not be parallel with the bottom surface 440 of the ice making receptacle 424. However, according to the various embodiments, regardless of the parallel/non-parallel relationship of the base 442 of the ice storage bin 430 and the bottom surface 440 of the ice making receptacle 424, the movement of the ice storage bin 430 from the engaged state 432 through the transitional and sliding states 452, 436 and to the disengaged state 434 is accomplished without rotating the ice storage bin 430, or substantially rotating the ice storage bin 430, during such movement. It is contemplated that a limited amount of wobble, vibration, or other limited non-linear movement may be possible. However, it should be understood that such limited non-linear movement is merely for operating clearance of the ice storage bin 430 with respect to the ice making receptacle 424.

Referring again to FIGS. 16-20, it is contemplated that the sliding assembly 438 can be configured to extend from the inward-facing surface 510 of the ice making receptacle 424 and into a portion of the ice making receptacle 424. As discussed above, the sliding assembly 438 can so extend into the ice making receptacle 424 from any of the inward facing surfaces of the ice making receptacle 424 including, but not limited to, the bottom surface 440, side surfaces 512, back surface 516, top surface 514, combinations thereof, and other various surfaces of the ice making receptacle 424. It is further contemplated that the ice storage bin 430 can include a receptacle assembly 530 that can include one or more tab receptacles 456 or other receptacle configurations. The receptacle assembly 530 is configured to slidably engage with the sliding assembly 438 to define the engaged and lateral sliding states 436 of the ice storage bin 430. By way of example, and not limitation, where the sliding assemblies are disposed on side surfaces 512 of the ice making receptacle 424, the receptacle assembly 530 of the ice storage bin 430 can be disposed on side portions 540 of the ice storage bin 430. Alternatively, it is contemplated that the sliding assembly 438 can be positioned on multiple inward facing surfaces of the ice making receptacle 424 for engagement with corresponding portions of the receptacle assembly 530 of the ice storage bin 430.

Referring again to FIG. 17, it is contemplated that when the ice storage bin 430 is in the engaged state 432, portions of the ice storage bin 430 can at least partially surround portions of the ice maker 426. In this configuration, minimal clearance is necessary between a top edge 490 of the ice storage bin 430 and an underside 550 of the ice maker 426 due to the minimal clearance needed for the vertical movement of the ice storage bin 430 as it moves through the transitional state 452. As discussed above, the transitional state 452 may define the only vertical movement of the ice storage bin 430 between the engaged state 432 and the disengaged state 434. Accordingly, rotational assemblies, tilting, and other similar rotating mechanisms are not needed to move the ice storage bin 430 from the engaged state 432 to the disengaged state 434.

Referring again to FIGS. 13-16, it is contemplated that the sliding assembly 438 can include a plurality of sliding tabs 454 that extend upward from a bottom surface 440 of the ice making receptacle 424. Each of the sliding tabs 454 of the plurality of sliding tabs 454 can include a portion of the lateral sliding surface 520 as well as a portion of the ramped surface 450. According to the various embodiments, it is also contemplated that the sliding tabs 454 can include a pair of forward tabs 560 and a pair of rearward tabs 562. According to various embodiments, it is contemplated that the pair of forward tabs 560 can be free of alignment with the pair of rearward tabs 562. Such an alignment, or lack of alignment, can prevent unintentional or unwanted engagement with a rear 486 of the ice storage bin 430 with the pair of forward tabs 560. Accordingly, the receptacle assembly 530 of the ice storage bin 430 includes a plurality of recesses or tab receptacles 456 that are spaced corresponding to the non-aligning pairs of forward and rearward tabs 562 of the sliding assembly 438. As the ice storage bin 430 is moved through the sliding state 436, the tab receptacles 456 of the receptacle assembly 530 positioned at the rear 486 of the ice storage bin 430 are spaced so as to not engage the pair of forward tabs 560. Instead, the ice storage bin 430 can be moved through the entire sliding state 436 up to the transitional state 452 wherein each of the recesses of the receptacle assembly 530 of the ice storage bin 430 engage the ramped surfaces 450 of each of the corresponding tabs 454 of the sliding assembly 438 so that the ice storage bin 430 can be moved into the engaged position.

According to various alternate embodiments, where the sliding assembly 438 includes multiple tabs 454, in order to prevent unwanted or unintentional engagement of a recess of the ice storage bin 430 with a non-corresponding tab 454 of the sliding assembly 438, the recesses and tabs 454 can be configured to include different alignments, locations, sizes, shapes, combinations thereof, and other similar configurations that are adapted to prevent a misalignment and/or disengagement of the ice storage bin 430 within the ice making receptacle 424.

Referring again to FIGS. 13-20, the ice making assembly for the appliance door 416 of the refrigerating appliance 410 can include the inner liner 420 that defines an ice making receptacle 424, wherein the bottom surface 440 of the ice making receptacle 424 at least partially defines the ice delivery chute 502. The ice storage bin 430 is configured to be selectively positioned between the engaged state 432 and the disengaged state 434. The ice storage bin 430 can include the ice delivery mechanism 506 that places the interior volume of the ice storage bin 430 in selective communication with the ice delivery chute 502 when the ice storage bin 430 is in the engaged state 432. It is contemplated that the ice storage bin 430 is free of vertical rotation and lateral rotation as the ice storage bin 430 is operated between the engaged state 432 and the disengaged state 434. An ice maker 426 can be positioned proximate a top of the ice making receptacle 424, wherein a portion of the ice storage bin 430 at least partially surrounds a front 484 of the ice maker 426 when the ice storage bin 430 is in the engaged state 432.

According to the various embodiments, it is contemplated that the ice making and/or harvesting assembly described above can be disposed within any one of various appliance doors 416 that can include, but are not limited to, refrigerator compartment doors, pantry compartment doors, freezer compartment doors, combinations thereof, and other similar compartment doors 16 of a refrigerating appliance 410. It is also contemplated that the ice making and/or harvesting assembly described above can be disposed within interior portions of the refrigerating appliance 410, such as within any one of the interior compartments 414 of the refrigerating appliance 410. Moreover, the ice making and/or harvesting assembly can be included in any one of various appliances, cabinetry, and other similar household locations.

It will be understood by one having ordinary skill in the art that construction of the described disclosure and other components is not limited to any specific material. Other exemplary embodiments of the disclosure disclosed herein may be formed from a wide variety of materials, unless described otherwise herein. It is within the scope of the present invention that a liquid other than water or ice may be dispensed from a storage location or directly from a supply of the liquid or other beverage. Primarily the present disclosure is directed to the use of filtered, treated or tap water received from a water source into the refrigerating appliance 410 and dispensed to the ice maker 426 by the refrigerating appliance 410 either before or after being optionally filtered or otherwise treated. The water may also be treated with supplements like, for example, vitamins, minerals or glucosamine and chondroitin or the like.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate the many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within the described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. An ice making appliance comprising:
a cabinet defining an interior volume; and
an automatic ice maker disposed within the interior volume and configured to harvest a plurality of ice cubes, the automatic ice maker comprising:
a frame;
a motor; and
an ice tray comprising:
a first end operably and rotationally engaged with the motor;
a second end engaged to the frame; and
a plurality of ice wells defined by a plurality of weirs including a first set of weirs positioned proximate the first end and a second set of weirs positioned proximate the second end and interior weirs positioned therebetween, each weir of the plurality of weirs including an upwardly extending projection that extends above the plurality of ice wells, and wherein each weir of the first and second sets of weirs and the interior weirs comprise passages at least partially bifurcating each weir into a first weir portion and a second weir portion.

2. The ice making appliance of claim 1, wherein each passage defined by the first and second sets of weirs includes a cross-sectional area that is greater than a cross-sectional area of each passage defined by the interior weirs.

3. The ice making appliance of claim 1, wherein the plurality of ice wells includes at least three rows of at least seven ice wells.

4. The ice making appliance of claim 1, wherein the ice tray is free of a heating element.

5. The ice making appliance of claim 1, wherein the automatic ice maker is disposed proximate a door that provides selective access to the interior volume.

6. The ice making appliance of claim 1, wherein each of the plurality of ice wells measures less than 11.25 milliliters.

7. The ice making appliance of claim 1, wherein each ice well of the plurality of ice wells has a fill volume, and a sum of the fill volumes of the plurality of ice wells defines a total fill volume, and where the total fill volume is at least about 110 milliliters.

8. The ice making appliance of claim 1, wherein the motor and the frame are configured to rotate the ice tray at least about 155 degrees in a first direction.

9. The ice making appliance of claim 1, wherein the automatic ice maker is free of an ice guide or bumper to aid in delivering ice into an ice bin.

10. The ice making appliance of claim 1, wherein the ice tray comprises a polypropylene-polyethylene copolymer.

11. The ice making appliance of claim 6, wherein each ice well of the plurality of ice wells includes an upper perimeter proximate a top surface of the ice tray, wherein the upper perimeter includes a width of less than 28 millimeters and a length of less than 28 millimeters.

12. The ice making appliance of claim 1, wherein the passages defined within the first and second sets of weirs are positioned nearer to a bottom of the ice tray than the passages defined within the interior weirs.

13. An ice tray for an ice making appliance, the ice tray comprising:
a first end operably and rotationally engaged with a motor;
a second end engaged to a frame; and
a plurality of ice wells defined by a plurality of weirs including a first set of weirs positioned proximate the first end and a second set of weirs positioned proximate the second end and interior weirs positioned therebetween, wherein each weir of the plurality of weirs includes an upwardly extending projection that extends above the plurality of ice wells, and wherein each of the first and second sets of weirs and the interior weirs comprise a passage at least partially bifurcating the upwardly extending projection of each weir of the plurality of weirs into a first weir portion and a second weir portion.

14. The ice tray of claim 13, wherein each of the passages defined by the first and second sets of weirs have a cross-sectional area that is greater than a cross-sectional area of any one of the passages defined by the interior weirs, and wherein each of the passages defined by the first and second sets of weirs has a first depth, and wherein each of the passages defined by the interior weirs has a second depth, wherein the first depth is greater than the second depth.

15. The ice tray of claim 13, wherein the plurality of ice wells includes at least three rows of at least seven ice wells.

16. The ice tray of claim 13, wherein each ice well of the plurality of ice wells measures less than 11.25 milliliters.

17. The ice tray of claim 15, wherein each ice well includes a generally rectangular upper perimeter having a width of less than 28 millimeters and a length of less than 28 millimeters.

18. The ice tray of claim 15, wherein the plurality of ice wells have a total fill volume and where the total fill volume is at least about 110 milliliters.

19. An ice making appliance comprising:

a cabinet having an ice making receptacle;

an ice maker disposed proximate a top portion of the ice making receptacle;

a sliding assembly defined within an inward-facing surface of the ice making receptacle, wherein the sliding assembly extends upward from a bottom surface of the ice making receptacle; and an ice storage bin operable between an engaged state, wherein the ice storage bin is fully inserted into the ice making receptacle, a disengaged state, wherein the ice storage bin is removed from the ice making receptacle, and a lateral sliding state, wherein the ice storage bin is operated laterally and free of rotation between the engaged and disengaged states, and wherein the ice storage bin includes a receptacle assembly that slidably engages the sliding assembly to define the engaged and lateral sliding states, and wherein the receptacle assembly is defined within a base of the ice storage bin, and wherein the ice storage bin and the ice making receptacle cooperatively define an ice delivery mechanism that selectively delivers ice pieces from an inner volume of the ice storage bin to an ice delivery zone proximate an exterior surface of the cabinet.

20. The ice making appliance of claim 19, wherein the sliding assembly defines a lateral sliding surface that is vertically offset from the bottom surface of the ice making receptacle, and further defines a ramped surface that defines a transition state, wherein sliding movement of the ice storage bin along the ramped surface vertically operates the ice storage bin between the engaged and lateral sliding states.

* * * * *